US010023947B2

(12) United States Patent
Azuma et al.

(10) Patent No.: US 10,023,947 B2
(45) Date of Patent: Jul. 17, 2018

(54) HIGH STRENGTH STEEL PLATE WITH ULTIMATE TENSILE STRENGTH OF 900 MPA OR MORE EXCELLENT IN HYDROGEN EMBRITTLEMENT RESISTANCE AND METHOD OF PRODUCTION OF SAME

(75) Inventors: Masafumi Azuma, Tokyo (JP); Noriyuki Suzuki, Tokyo (JP); Naoki Maruyama, Tokyo (JP); Akinobu Murasato, Tokyo (JP); Yasuharu Sakuma, Tokyo (JP); Hiroyuki Kawata, Tokyo (JP); Chisato Wakabayashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1091 days.

(21) Appl. No.: 13/508,779

(22) PCT Filed: Nov. 30, 2010

(86) PCT No.: PCT/JP2010/071776

§ 371 (c)(1),
(2), (4) Date: May 9, 2012

(87) PCT Pub. No.: WO2011/065591

PCT Pub. Date: Jun. 3, 2011

(65) Prior Publication Data

US 2012/0222781 A1 Sep. 6, 2012

(30) Foreign Application Priority Data

Nov. 30, 2009 (JP) ..... 2009-272075
Sep. 16, 2010 (JP) ..... 2010-208328

(51) Int. Cl.

| | |
|---|---|
| ***C21D 8/00*** | (2006.01) |
| ***C22C 38/04*** | (2006.01) |
| ***C22C 38/02*** | (2006.01) |
| ***C23C 2/06*** | (2006.01) |
| ***C21D 9/46*** | (2006.01) |
| ***C22C 38/00*** | (2006.01) |
| ***C22C 38/06*** | (2006.01) |
| ***C23C 2/28*** | (2006.01) |
| ***C25D 5/36*** | (2006.01) |
| ***C23C 2/40*** | (2006.01) |

(52) U.S. Cl.

CPC ..... *C23C 2/06* (2013.01); *C21D 9/46* (2013.01); *C22C 38/001* (2013.01); *C22C 38/02* (2013.01); *C22C 38/04* (2013.01); *C22C 38/06* (2013.01); *C23C 2/28* (2013.01); *C23C 2/40* (2013.01); *C25D 5/36* (2013.01); *C21D 2211/002* (2013.01); *C21D 2211/004* (2013.01); *C21D 2211/005* (2013.01); *C21D 2211/008* (2013.01)

(58) Field of Classification Search

CPC ..... C21D 9/46; C22C 38/001; C22C 38/00; C25D 5/36; C23C 2/00

See application file for complete search history.

(56) References Cited

U.S. PATENT DOCUMENTS

| | | | | |
|---|---|---|---|---|
| 2006/0191612 | A1* | 8/2006 | Yoshida | C22C 38/12 148/603 |
| 2007/0079913 | A1* | 4/2007 | Krajewski | C22F 1/06 148/667 |
| 2008/0000555 | A1* | 1/2008 | Nonaka | B21B 3/02 148/328 |
| 2010/0096279 | A1* | 4/2010 | Kojima | B65D 83/38 206/0.6 |
| 2011/0008647 | A1* | 1/2011 | Azuma | C21D 8/04 428/659 |
| 2011/0030854 | A1 | 2/2011 | Matsuda et al. | |

FOREIGN PATENT DOCUMENTS

| | | | |
|---|---|---|---|
| CN | 102296232 | A * | 12/2011 |
| EP | 1808505 | | 7/2007 |
| JP | 7-197183 | | 8/1995 |
| JP | 09-013147 | | 1/1997 |
| JP | 10-060574 | | 3/1998 |
| JP | 10130801 | A * | 5/1998 |
| JP | 11-100638 | | 4/1999 |
| JP | 11158688 | A * | 6/1999 |
| JP | 11-279691 | | 10/1999 |
| JP | 11-293383 | | 10/1999 |
| JP | 2002-097560 | | 4/2002 |

(Continued)

OTHER PUBLICATIONS

R. Ueji , N. Tsuji,* , Y. Minamino, Y. Koizumi Ultragrain refinement of plain low carbon steel by coldrolling and annealing of martensite Acta Materialia 50 (2002) 4177-4189.*

International Search Report dated Mar. 1, 2011, issued in corresponding PCT Application No. PCT/JP2010/071776.

"Advances in Delayed Fracture Solution," (the Iron and Steel Institute of Japan, Jan. 1997), with an English translation thereof.

CAMP-ISIJ, vol. 5, No. 6, pp. 1839 to 1842, Yamazaki et al., Oct. 1992, issued by the Iron and Steel Institute of Japan, with an English translation thereof.

*Primary Examiner* — Jenny R Wu

(74) *Attorney, Agent, or Firm* — Birch, Stewart, Kolasch & Birch, LLP

(57) ABSTRACT

High strength steel plate with an ultimate tensile strength of 900 MPa or more which is excellent in hydrogen embrittlement resistance characterized in that, in the structure of the steel plate, (a) by volume fraction, ferrite is present in 10 to 50%, bainitic ferrite and/or bainite in 10 to 60%, and tempered martensite in 10 to 50%, and (b) iron-based carbides which contain Si or Si and Al in 0.1% or more are present in $4\times10^8$ (particles/mm$^3$) or more.

14 Claims, No Drawings

(56) References Cited

FOREIGN PATENT DOCUMENTS

| | | | | |
|---|---|---|---|---|
| JP | 2002-363695 | | 12/2002 | |
| JP | 2003-105514 | | 4/2003 | |
| JP | 2003-213369 | | 7/2003 | |
| JP | 2003-213370 | | 7/2003 | |
| JP | 2005-068548 | | 3/2005 | |
| JP | 2006-283131 | | 10/2006 | |
| JP | 2007-211279 | | 8/2007 | |
| WO | 2009/096596 | | 8/2009 | |
| WO | WO 2009119751 | A1 * | 10/2009 | ..... C21D 8/04 |

* cited by examiner

HIGH STRENGTH STEEL PLATE WITH ULTIMATE TENSILE STRENGTH OF 900 MPA OR MORE EXCELLENT IN HYDROGEN EMBRITTLEMENT RESISTANCE AND METHOD OF PRODUCTION OF SAME

This application is a national stage application of International Application No. PCT/JP2010/071776, filed Nov. 30, 2010, which claims priority to Japanese Application Nos. 2009-272075, filed Nov. 30, 2009, and 2010-208328, filed Sep. 16, 2010 the content of which is incorporated by reference in its entirety.

TECHNICAL FIELD

The present invention relates to high strength steel plate with an ultimate tensile strength of 900 MPa or more which is excellent in hydrogen embrittlement resistance and a method of production of the same.

BACKGROUND ART

In recent years, increasingly higher strength has been demanded from steel plate which is used for automobiles, buildings, etc. For example, high strength cold rolled steel plate with an ultimate tensile strength of 900 MPa or more is being rapidly applied as bumpers, impact beams, and other reinforcing members. However, at the time of application of high strength steel plate, it is necessary to solve the problem of prevention of delayed fracture.

"Delayed fracture" is the phenomenon of sudden fracture of a steel member (for example, PC steel wire, bolts) on which a high stress acts under the conditions of use. It is known that this phenomenon is closely related to the hydrogen which penetrates the steel from the environment.

As a factor greatly affecting delayed fracture of steel members, the steel plate strength is known. Steel plate is more resistant to plastic deformation and fracture the higher the strength, so there is a high possibility of use in an environment in which a high stress acts.

Note that, if using a low strength steel member for a member on which a high stress acts, the member plastically deforms and fractures, so delayed fracture does not occur.

In a steel member which is shaped from steel plate such as steel plate for automobile use, the residual stress which occurs after shaping becomes larger the higher the steel plate strength, so there is a high concern over the occurrence of delayed fracture. That is, in a steel member, the higher the strength of the steel, the higher the concern over the occurrence of delayed fracture.

In the past, much effort has been made in the fields of steel bars or thick-gauge steel plate to develop steel materials taking delayed fracture resistance into consideration. For example, in steel bars and steel for bolt use, development has focused on formation of tempered martensite. It has been reported that Cr, Mo, V, and other elements which raise the temper softening resistance are effective for improvement of the delayed fracture resistance (for example, see NPLT 1).

This is art for causing the precipitation of alloy carbides, which act as trap sites of hydrogen, so as to change the mode of delayed fracture from grain boundary fracture to intragranular fracture.

However, the steel which is described in NPLT 1 contains 0.4% or more of C and a large amount of alloy elements, so the workability and weldability which are required from steel sheet deteriorate. Further, to cause the precipitation of alloy carbides, several hours or more of heat treatment is necessary, so the art of NPLT 1 had the problem of manufacturability of steel.

PLT 1 describes using oxides mainly comprised of Ti and Mg to prevent the occurrence of hydrogen defects. However, this art covers thick steel plate and considers delayed fracture after large heat input welding, but both the high workability and delayed fracture resistance which are demanded from steel sheet are not considered.

In steel sheet, since the thickness is small, even if hydrogen penetrates it, it is released in a short time. Further, in terms of workability, steel plate with an ultimate tensile strength of 900 MPa or more had almost never been used before, so the problem of delayed fracture had been treated as small. However, today, use of high strength steel sheet is rising, so development of high strength steel plate with excellent hydrogen embrittlement resistance has become necessary.

Up to now, the art for raising the hydrogen embrittlement resistance almost all relates to steel material which is used at the proof stress or yield stress or less as bolts, steel bars, thick steel plate, and other such products. That is, the prior art is not art covering steel materials (steel plate) such as for members of automobiles where workability (cuttability, press formability, etc.) and, simultaneously, hydrogen embrittlement resistance are sought.

Usually, a member obtained by shaping steel plate has residual stress remaining inside of the member. Residual stress is local, but sometimes exceeds the yield stress of the material steel plate. For this reason, steel plate free of hydrogen embrittlement even if high residual stress remains inside the member has been sought.

Regarding the delayed fracture of steel sheet, for example, NPLT 2 reports about the aggravation of delayed fracture due to work-induced transformation of retained austenite. This considers the shaping of steel sheet. NPLT 2 describes an amount of retained austenite not causing deterioration of the delayed fracture resistance.

That is, the above report relates to high strength steel sheet which has a specific structure. This cannot be said to be a fundamental measure for improvement of the delayed fracture resistance.

PLT 2 describes steel plate for enamelware use which is excellent in fishscale resistance as steel sheet considering hydrogen trapping ability and shapeability. This traps the hydrogen which penetrates steel plate at the time of production as oxides in the steel plate and suppresses the occurrence of "fishscale" (surface defects) which occur after enameling.

However, with the art of PLT 2, the steel plate contains a large amount of oxides inside of it. If oxides disperse in the steel plate at a high density, the shapeability deteriorates, so it is difficult to apply the art of PLT 2 to steel plate for automobile use from which a high shapeability is required. Furthermore, the art of PLT 2 does not achieve both high strength and delayed fracture resistance.

To solve these problems, steel plate in which oxides are precipitated has been proposed (for example, see PLT 3). In such steel plate, the oxides which are dispersed in the steel plate act as trap sites which trap the hydrogen which has penetrated the steel, so dispersion or concentration of hydrogen at locations where stress concentrate and locations where delayed fracture is of a concern is suppressed.

However, to obtain such an effect, steel plate must have oxides dispersed in it at a high density. Strict control of the production conditions is necessary.

Relating to high strength steel plate, for example, there are the arts of PLTs 4 to 9. Further, relating to hot dip galvanized steel plate, for example, there is the art of PLT 10, but as explained above, it is extremely difficult to develop high strength steel plate wherein both delayed fracture resistance and good shapeability are achieved.

PLT 11 discloses ultrahigh strength steel strip which has a tensile strength of 980 N/mm$^2$ or more and is excellent in durability. In this ultrahigh strength steel strip, hydrogen delayed cracking resistance is considered, but basically martensite is used to handle the delayed fracture resistance (conventional method), so the shapeability is insufficient.

PLT 12 discloses high strength steel strip which has a tensile strength of 980 MPa or more and is excellent in hydrogen embrittlement resistance. PLT 13 discloses high strength cold rolled steel plate which is excellent in workability and hydrogen embrittlement resistance.

However, in all of this steel plate, the amount of particles which precipitate inside the grains is large. The hydrogen embrittlement resistance does not reach the level which is currently sought. Therefore, development of high strength steel plate which achieves both delayed fracture resistance and good shapeability has been strongly sought.

CITATIONS LIST

Patent Literature

PLT 1: Japanese Patent Publication (A) No. 11-293383
PLT 2: Japanese Patent Publication (A) No. 11-100638
PLT 3: Japanese Patent Publication (A) No. 2007-211279
PLT 4: Japanese Patent Publication (A) No. 11-279691
PLT 5: Japanese Patent Publication (A) No. 09-013147
PLT 6: Japanese Patent Publication (A) No. 2002-363695
PLT 7: Japanese Patent Publication (A) No. 2003-105514
PLT 8: Japanese Patent Publication (A) No. 2003-213369
PLT 9: Japanese Patent Publication (A) No. 2003-213370
PLT 10: Japanese Patent Publication (A) No. 2002-097560
PLT 11: Japanese Patent Publication (A) No. 10-060574
PLT 12: Japanese Patent Publication (A) No. 2005-068548
PLT 13: Japanese Patent Publication (A) No. 2006-283131

Non Patent Literature

NPLT 1: "New Developments in Elucidation of Hydrogen Embrittlement" (the Iron and Steel Institute of Japan, January 1997)
NPLT 2: CAMP-ISIJ, Vol. 5, No. 6, Pages 1839 to 1842, Yamazaki et al., October 1992, issued by the Iron and Steel Institute of Japan

SUMMARY OF INVENTION

Technical Problem

In the prior art, high strength steel plate with an ultimate tensile strength of 900 MPa or more which has the hydrogen embrittlement resistance which is sought has not been obtained.

The present invention has as its object the provision of high strength steel plate which has a high strength of the ultimate tensile strength 900 MPa or more and which has an excellent hydrogen embrittlement resistance, in consideration of the fact that development of high strength steel plate achieving both delayed fracture resistance and excellent shapeability is being strongly sought, and a method of production of the same.

Solution to Problem

1) The inventors studied the techniques for solving the above problems in detail. As a result, they learned that if precipitating (A) iron-based carbides which contain "Si" or "Si and Al" in an amount of 0.1% or more in the steel plate structure, it is possible to achieve both delayed fracture resistance and good shapeability (details explained later).

The present invention (high strength steel plate) was made based on the above discovery and has as its gist the following.

(1) High strength steel plate with an ultimate tensile strength of 900 MPa or more which is excellent in hydrogen embrittlement resistance characterized in that, in the structure of the steel plate, (a) by volume fraction, ferrite is present in 10 to 50%, bainitic ferrite and/or bainite in 10 to 60%, and tempered martensite in 10 to 50%, and (b) iron-based carbides which contain Si or Si and Al in 0.1% or more are present in $4\times10^8$ (particles/mm$^3$) or more.

(2) High strength steel plate with an ultimate tensile strength of 900 MPa or more which is excellent in hydrogen embrittlement resistance as set forth in (1) characterized in that, in the structure of the steel plate, by volume fraction, fresh martensite is present in 10% or less.

(3) High strength steel plate with an ultimate tensile strength of 900 MPa or more which is excellent in hydrogen embrittlement resistance as set forth in (1) or (2) characterized in that, in the structure of the steel plate, by volume fraction, retained austenite is present in 2 to 25%.

(4) High strength steel plate with an ultimate tensile strength of 900 MPa or more which is excellent in hydrogen embrittlement resistance as set forth in any one of (1) to (3) characterized in that the iron-based carbides are present in the bainite and/or tempered martensite.

(5) High strength steel plate with an ultimate tensile strength of 900 MPa or more which is excellent in hydrogen embrittlement resistance as set forth in any one of (1) to (4) characterized in that the steel plate contains, by mass %, C: 0.07% to 0.25%, Si: 0.45 to 2.50%, Mn: 1.5 to 3.20%, P: 0.001 to 0.03%, S: 0.0001 to 0.01%, Al: 0.005 to 2.5%, N: 0.0001 to 0.0100%, and O: 0.0001 to 0.0080% and has a balance of iron and unavoidable impurities.

(6) High strength steel plate with an ultimate tensile strength of 900 MPa or more which is excellent in hydrogen embrittlement resistance as set forth in (5) characterized in that the steel plate further contains, by mass %, one or both of Ti: 0.005 to 0.09% and Nb: 0.005 to 0.09%.

(7) High strength steel plate with an ultimate tensile strength of 900 MPa or more which is excellent in hydrogen embrittlement resistance as set forth in (5) or (6) characterized in that the steel plate further contains, by mass %, one or more of B: 0.0001 to 0.01%, Cr: 0.01 to 2.0%, Ni: 0.01 to 2.0%, Cu: 0.01 to 0.05%, and Mo: 0.01 to 0.8%.

(8) High strength steel plate with an ultimate tensile strength of 900 MPa or more which is excellent in hydrogen embrittlement resistance as set forth in any one of (5) to (7) characterized in that the steel plate further contains, by mass %, V: 0.005 to 0.09%.

(9) High strength steel plate with an ultimate tensile strength of 900 MPa or more which is excellent in hydrogen embrittlement resistance as set forth in any one of (5) to (8)

characterized in that the steel plate further contains, by mass %, one or more of Ca, Ce, Mg, and REM in a total of 0.0001 to 0.5%.

(10) High strength steel plate with an ultimate tensile strength of 900 MPa or more which is excellent in hydrogen embrittlement resistance as set forth in any one of (1) to (9) characterized in that the steel plate has a galvanized layer on its surface.

2) The inventors studied further studied a method of causing iron-based carbides which contain "Si" or "Si and Al" in 0.1% or more to precipitate in a steel plate structure.

As a result, it was learned that (B) if deforming steel plate which has been cooled to 250° C. or less by bending-unbending, it is possible to introduce nucleation sites at which iron-based carbides which contain "Si" or "Si and Al" precipitate, then (C) if heat treating the steel plate to 150 to 400° C., it is possible to cause iron-based carbides which contain "Si" or "Si and Al" to precipitate in large amounts in the steel plate structure in an extremely short time (details explained later).

The present invention (method of production) was made based on the above discovery and has as its gist the following.

(11) A method of production for producing high strength steel plate with an ultimate tensile strength of 900 MPa or more which is excellent in hydrogen embrittlement resistance as set forth in any one of (1) to (9), the method of production for producing high strength steel plate with an ultimate tensile strength of 900 MPa or more which is excellent in hydrogen embrittlement resistance characterized by (x) casting a slab which has a chemical composition as set forth in any one of (5) to (9), directly, or after once cooling, heating to a 1050° C. or more temperature and hot rolling, finishing the hot rolling at a temperature of the $Ar_3$ transformation point or more, coiling at a 400 to 670° C. temperature region, pickling, then cold rolling by a draft of 40 to 70%, next, (y) using a continuous annealing line for annealing at a maximum heating temperature of 760 to 900° C., then cooling by an average cooling rate of 1 to 1000° C./sec down to 250° C. or less, next (z) deforming the steel by rolls of a radius of 800 mm or less by bending-unbending, then performing heat treatment in the 150 to 400° C. temperature region for 5 seconds or more.

(12) A method of production for producing high strength steel plate with an ultimate tensile strength of 900 MPa or more which is excellent in hydrogen embrittlement resistance as set forth in any one of (1) to (9), the method of production for producing high strength steel plate with an ultimate tensile strength of 900 MPa or more which is excellent in hydrogen embrittlement resistance characterized by (x) casting a slab which has a chemical composition as set forth in any one of (5) to (9), directly, or after once cooling, heating to a 1050° C. or more temperature and hot rolling, finishing the hot rolling at a temperature of the $Ar_3$ transformation point or more, coiling at a 400 to 670° C. temperature region, pickling, then cold rolling by a draft of 40 to 70%, next, (y) using a continuous annealing line for annealing at a maximum heating temperature of 760 to 900° C., then cooling by an average cooling rate of 1 to 1000° C./sec down to the Ms point to the Ms point −100° C., next (z) deforming the steel by rolls of a radius of 800 mm or less by bending-unbending, then performing heat treatment in the 150 to 400° C. temperature region for 5 seconds or more.

(13) A method of production for producing high strength steel plate with an ultimate tensile strength of 900 MPa or more which is excellent in hydrogen embrittlement resistance as set forth in (10), the method of production for producing high strength steel plate with an ultimate tensile strength of 900 MPa or more which is excellent in hydrogen embrittlement resistance characterized by galvanizing the steel plate surface after the heat treatment of (z).

(14) A method of production for producing high strength steel plate with an ultimate tensile strength of 900 MPa or more which is excellent in hydrogen embrittlement resistance as set forth in (13), characterized in that the galvanization is electrogalvanization.

(15) A method of production for producing high strength steel plate with an ultimate tensile strength of 900 MPa or more which is excellent in hydrogen embrittlement resistance as set forth in (10), the method of production for producing high strength steel plate with an ultimate tensile strength of 900 MPa or more which is excellent in hydrogen embrittlement resistance characterized by (x) casting a slab which has a chemical composition as set forth in any one of (5) to (9), directly, or after once cooling, heating to a 1050° C. or more temperature and hot rolling, finishing the hot rolling at a temperature of the $Ar_3$ transformation point or more, coiling at a 400 to 670° C. temperature region, pickling, then cold rolling by a draft of 40 to 70%, next, (y) using a continuous hot dip galvanization line for annealing at a maximum heating temperature of 760 to 900° C., then cooling by an average cooling rate of 1 to 1000° C./sec, then dipping in a galvanization bath and cooling by an average cooling rate of 1° C./second or more down to 250° C. or less, next, (z) deforming the steel by rolls of a radius of 800 mm or less by bending-unbending, then performing heat treatment in the 150 to 400° C. temperature region for 5 seconds or more.

(16) A method of production for producing high strength steel plate with an ultimate tensile strength of 900 MPa or more which is excellent in hydrogen embrittlement resistance as set forth in (10), the method of production for producing high strength steel plate with an ultimate tensile strength of 900 MPa or more which is excellent in hydrogen embrittlement resistance characterized by (x) casting a slab which has a chemical composition as set forth in any one of (5) to (9), directly, or after once cooling, heating to a 1050° C. or more temperature and hot rolling, finishing the hot rolling at a temperature of the $Ar_3$ transformation point or more, coiling at a 400 to 670° C. temperature region, pickling, then cold rolling by a draft of 40 to 70%, next, (y) using a continuous hot dip galvanization line for annealing at a maximum heating temperature of 760 to 900° C., then cooling by an average cooling rate of 1 to 1000° C./sec, then dipping in a galvanization bath and cooling by an average cooling rate of 1° C./second or more down to the Ms point to the Ms point −100° C., next, (z) deforming the steel by rolls of a radius of 800 mm or less by bending-unbending, then performing heat treatment in the 150 to 400° C. temperature region for 5 seconds or more.

(17) A method of production for producing high strength steel plate with an ultimate tensile strength of 900 MPa or more which is excellent in hydrogen embrittlement resistance as set forth in (15) or (16) characterized by performing alloying treatment at a 460 to 600° C. temperature after dipping in the galvanization bath, then cooling by an average cooling rate of 1° C./second or more down to 250° C. or less.

Advantageous Effects of Invention

According to the present invention, it is possible to achieve both delayed fracture resistance and good shapeability to provide high strength steel plate with an ultimate tensile strength of 900 MPa or more which is excellent in hydrogen embrittlement resistance.

DESCRIPTION OF EMBODIMENTS

The high strength steel plate of the present invention (hereinafter sometimes referred to as "the steel plate of the present invention") is characterized in that, in the structure of the steel plate, (a) by volume fraction, ferrite is present in 10 to 50%, bainitic ferrite and/or bainite in 10 to 60%, and tempered martensite in 10 to 50%, and (b) iron-based carbides which contain Si or Si and Al in 0.1% or more are present in $4\times10^8$ (particles/$mm^3$) or more.

First, the characteristics of the steel plate of the present invention will be explained.

The structure of the steel plate of the present invention, to secure a good ductility, has ferrite as a main phase and additionally contains, as hard structures, martensite, bainite, or retained austenite alone or in combination. Note that, to raise the hole expandability, the steel plate structure may also be made a single martensite phase or a composite phase structure of martensite and bainite.

The steel plate structure of the steel plate of the present invention contains, by volume fraction, ferrite: 10 to 50%, bainitic ferrite and/or bainite: 10 to 60%, and tempered martensite: 10 to 50%. In addition, retained austenite: 2 to 25% and fresh martensite: 10% or less may be contained. The steel plate of the present invention which includes the above steel plate structure has a much higher strength and excellent ductility and stretch flange formability (hole expandability).

First, the reasons for defining the volume fraction of the steel plate structure will be explained.

Ferrite: 10 to 50%

Ferrite is a structure which is effective for improvement of the ductility. The volume fraction of ferrite is made 10 to 50%. If the volume fraction is less than 10%, it is difficult to secure sufficient ductility, so the lower limit is made 10%. The volume fraction is preferably 15% or more, more preferably 20% or more, from the viewpoint of securing sufficient ductility.

On the other hand, ferrite is a soft structure, so if the volume fraction exceeds 50%, the yield stress falls. For this reason, the upper limit is made 50%. The volume fraction is preferably 45% or less, more preferably 40% or less, from the viewpoint of sufficiently raising the yield stress of high strength steel plate.

Note that, the ferrite may be any of recrystallized ferrite not containing almost any dislocations, precipitation strengthened ferrite, as worked non-recrystallized ferrite, and ferrite with part of the dislocations reversed.

Bainitic Ferrite and/or Bainite: 10 to 60%

Bainitic ferrite and/or bainite is a structure which has a hardness between soft ferrite and hard tempered martensite and/or fresh martensite. To improve the stretch flange formability of the steel plate of the present invention, the steel plate structure contains this, by volume fraction, in 10 to 60%.

If the volume fraction is less than 10%, a sufficient stretch flange formability cannot be obtained, so the lower limit is made 10%. The volume fraction is preferably 15% or more, more preferably 20% or more, from the viewpoint of maintaining a good stretch flange formability.

On the other hand, if the volume fraction exceeds 60%, it becomes difficult to form both ferrite and tempered martensite in suitable amounts and the balance of ductility and yield stress deteriorates, so the upper limit is made 60%. The volume fraction is preferably 55% or less, more preferably 50% or less, from the viewpoint of maintaining a good balance of ductility and yield stress.

Tempered Martensite: 10 to 50%

Tempered martensite is a structure which greatly improves the yield stress, so the volume fraction is made 10 to 50%. If the volume fraction is less than 10%, sufficient yield stress is not obtained, so the lower limit is made 10%. The volume fraction is preferably 15% or more, more preferably 20% or more from the viewpoint of securing sufficient yield stress.

On the other hand, if the volume fraction exceeds 50%, it is difficult to secure the ferrite and retained austenite which are required for improvement of the ductility, so the upper limit is made 50%. The volume fraction is preferably 45% or less, more preferably 40% or less, from the viewpoint of sufficiently improving the ductility.

Note that, the tempered martensite which is contained in the steel plate structure of the steel plate of the present invention is preferably low temperature tempered martensite. Low temperature tempered martensite has a dislocation density, observed using a transmission type electron microscope, of $10^{14}/m^2$ or more and is, for example, obtained by 150 to 400° C. low temperature heat treatment.

For example, high temperature tempered martensite which is obtained by 650° C. or higher high temperature heat treatment has concentrated dislocations, so the dislocation density observed using a transmission type electron microscope is less than $10^{14}/m^2$.

If the dislocation density of the tempered martensite is $10^{14}/m^2$ or more, it is possible to obtain steel plate which has a much better strength. Therefore, in the steel plate of the present invention, if the tempered martensite of the steel plate structure is low temperature tempered martensite, it is possible to obtain a much better strength.

Retained Austenite: 2 to 25%

Retained austenite is a structure which is effective for improvement of the ductility. If the volume fraction is less than 2%, sufficient ductility cannot be obtained, so the lower limit is made 2%. The volume fraction is preferably 5% or more, more preferably 8% or more, from the viewpoint of reliably securing ductility.

On the other hand, to make the volume fraction over 25%, it is necessary to add a large amount of austenite stabilizing elements such as C and Mn. As a result, the weldability remarkably deteriorates, so the upper limit is made 25%. The volume fraction is preferably 21% or less, more preferably 17%, from the viewpoint of securing the weldability.

Note that, having the steel plate structure of the steel plate of the present invention contain retained austenite is effective from the viewpoint of improvement of the ductility, but when sufficient ductility is maintained, retained austenite need not be present.

Fresh Martensite: 10% or Less

Fresh martensite reduces the yield stress and the stretch flange formability, so is made 10% or less by volume fraction. From the viewpoint of raising the yield stress, the volume fraction is preferably made 5% or less, more preferably 2% or less.

Other Metal Structures

The steel plate structure of the steel plate of the present invention may also contain pearlite and/or coarse cementite or other structures. However, if the pearlite and/or coarse cementite becomes greater, the ductility particularly deteriorates, so the volume fraction in total is preferably 10% or less, more preferably 5% or less.

The ferrite, pearlite, martensite, bainite, austenite, and other metal structures which form the steel plate structure can be identified, the positions of presence can be confirmed, and the area rate can be measured by using a Nital reagent and the reagent disclosed in Japanese Patent Publication (A) No. 59-219473 to corrode the cross-section in the rolling direction of the steel plate or the cross-section in the direction perpendicular to the rolling direction and observing the structures by a 1000× optical microscope and 1000 to 100000× scan type or transmission type electron microscope.

Further, the structures may be judged from analysis of the crystal orientation by the EBSP method using FE-SEM or measurement of the hardness of microregions such as measurement of the micro Vickers hardness.

The volume fraction of the structures which are contained in the steel plate structure of the steel plate of the present invention can, for example, be obtained by the method which is shown below.

The volume fraction of the retained austenite is found by X-ray analysis using the surface parallel to and at ¼ thickness from the surface of the steel plate as the observed surface, calculation of the area percentage of retained austenite, and use of this as the volume fraction.

The volume fractions of the ferrite, bainitic ferrite, bainite, tempered martensite, and fresh martensite are found by obtaining a sample using as an observed surface a cross-section of thickness parallel to the rolling direction of the steel plate, polishing the observed surface, etching it by Nital, observing the range of ⅛ to ⅜ thickness from ¼ of the plate thickness by a field emission scanning electron microscope (FE-SEM) to measure the area percentages, and using these as the volume fractions.

Note that, in observation by an FE-SEM, for example, it is possible to classify structures at an observed surface of a square of 30 μm sides as follows:

Ferrite is comprised of clumps of crystal grains inside of which iron-based carbides with long axes of 100 nm or more are not contained. Note that, the volume fraction of ferrite is the sum of the volume fractions of the ferrite remaining at the maximum heating temperature and the ferrite which is newly formed in the ferrite transformation temperature region.

Direct measurement of the volume fraction of ferrite during production is difficult, so in the steel plate of the present invention, a small piece of steel plate before being run through a continuous annealing line or continuous hot dip galvanization line is cut out, the steel piece is annealed by the same heat history as when run through a continuous annealing line or continuous hot dip galvanization line, the change in volume of the ferrite in the small piece is measured, and the value calculated using the results is used as the volume fraction of the ferrite.

Bainitic ferrite is a collection of lath-shaped crystal grains inside of which no iron-based carbides with long axes of 20 nm or more are contained.

Bainite is a collection of lath-shaped crystal grains inside of which iron-based carbides with long axes of 20 nm or more are contained.

Furthermore, the carbides fall under a single variant, that is, the group of iron-based carbides stretched in the same direction. Here, "the group of iron-based carbides stretched in the same direction" means carbides with a difference of the stretched direction of the group of iron-based carbides within 5°.

Tempered martensite is a collection of lath-shaped crystal grains inside of which iron-based carbides with long axes of 20 nm or more are contained. Furthermore, the carbides fall under several variants, that is, a plurality of groups of iron-based carbides stretched in different directions.

Note that, by using FE-SEM to observe the lath-shaped iron-based carbides inside of the crystal grains and investigating the stretching direction, it is possible to easily differentiate bainite and tempered martensite.

The fresh martensite and retained austenite are not sufficiently corroded by Nital etching, so in observation by FE-SEM, it is possible to clearly differentiate the above structures (ferrite, bainitic ferrite, bainite, and tempered martensite). For this reason, the volume fraction of the fresh martensite can be found as the difference between the area percentage of uncorroded regions which are obtained by the FE-SEM and the area percentage of retained austenite which is measured by X-rays.

The steel plate of the present invention is characterized by containing $4\times10^8$ (particles/mm$^3$) or more iron-based carbides which contain Si or Si and Al in 0.1% or more.

In the steel plate of the present invention, by having the iron-based carbides include Si or Si and Al, the hydrogen trapping ability of the iron-based carbides is improved and an excellent hydrogen embrittlement resistance (delayed fracture resistance) is obtained.

First, the reasons why the inventors took note of iron-based carbides will be explained.

To cause the precipitation of V-based, Ti-based, Nb-based, and Mo-based alloy carbides, long term heat treatment is required, so when producing steel plate on the production lines of steel sheet such as the continuous annealing line or continuous hot dip galvanization line, it is not possible to sufficiently cause the precipitation of the alloy carbides in the steel plate. To make the alloy carbides sufficiently precipitate, additional heat treatment is necessary.

To cause precipitation of V-based, Ti-based, Nb-based, and Mo-based alloy carbides, the steel plate which was run through a continuous annealing line or continuous hot dip galvanization line has to be treated by a long period of additional heat treatment at a high temperature of 600° C. or so at which diffusion of alloy elements is easy. As a result, a drop in strength of the steel plate cannot be avoided.

Based on these, the inventors took note of iron-based carbides which precipitate at a low temperature in a short time. Steel plate contains a sufficiently large amount of Fe, so it is not necessary to make Fe atoms diffuse over long distances in order to cause cementite or other iron-based carbides to precipitate. For this reason, the iron-based carbides can precipitate in a short time even at a low temperature of about 300° C.

However, iron-based carbides such as cementite have a small hydrogen trapping ability and do not contribute much to improvement of the hydrogen embrittlement resistance (delayed fracture resistance). The reason is that this is closely related with the mechanism of hydrogen trapping. That is, the hydrogen is trapped at the interface between the precipitates and base phase, but iron-based carbides are compatible with the base phase and are hard to precipitate, so it is believed that the hydrogen trapping ability is small.

Therefore, the inventors studied raising the compatibility of the iron-based carbides and base phase and imparting hydrogen trapping ability to the iron-based carbides. As a result, while the detailed mechanism is unclear, it is learned that if including "Si" or "Si and Al" in the iron-based carbides, the hydrogen embrittlement resistance (delayed fracture resistance) is greatly improved.

By making the iron-based carbides contain Si or Al, the compatibility of the iron-based carbides and base phase rises and the hydrogen trapping ability is improved.

However, Si and Al do not form solid solutions much at all in cementite and greatly delay the precipitation of cementite, so it is difficult to cause the precipitation of iron-based carbides which contain "Si" or "Si and Al".

The inventors engaged in intensive studies and discovered that if (a) deforming steel plate which was cooled to 250° C. or less by bending-unbending to introduce dislocations which form nucleation sites of iron-based carbides, (b) realigning dislocations appearing in the microstructure of the steel plate to form locations where dislocations are present in a high density and introduce nucleation sites where iron-based carbides which contain "Si" or "Si and Al" precipitate, then (c) heat treating the steel plate at 150 to 400° C., it is possible to cause iron-based carbides which contain "Si" or "Si and Al" to precipitate in an extremely short time in large amounts. This point is the discovery forming the basis of the present invention.

The inventors engaged in further development and obtained the following discoveries.

By cooling the steel to the martensite transformation start temperature (Ms point) or less and transforming part of the austenite to the martensite phase, dislocations forming the nucleation sites of iron-based carbides are made to form in large amounts at the martensite phase and its surroundings. Even if deforming such steel plate by bending-unbending and then heat treating it at 150 to 400° C., it is possible to make iron-based carbides which contain "Si" or "Si and Al" precipitate in large amounts in an extremely short time. This point is also a discovery forming the basis of the present invention.

Si is an element which delays the precipitation of cementite and other iron-based carbides and is not contained much at all in cementite, so the effect of improvement of the delayed fracture resistance by iron-based carbides which contain Si had not been discovered before.

In this way, the inventors established the technique of causing iron-based carbides which contain "Si" or "Si and Al" to precipitate in large amounts in an extremely short time with good compatibility with the base phase in the steel plate structure.

If the "Si" or "Si and Al" which is contained in the iron-based carbides is less than 0.1%, the hydrogen trapping ability becomes insufficient, so the amount of "Si" or "Si and Al" which is contained in the iron-based carbides becomes 0.1% or more. The amount is preferably 0.15% or more, more preferably 0.20% or more.

In the steel plate of the present invention, to obtain sufficient hydrogen embrittlement resistance, it is necessary to include $4\times10^8$ (particles/mm$^3$) or more of iron-based carbides. If the number of iron-based carbides is less than $4\times10^8$ (particles/mm$^3$), the hydrogen embrittlement resistance (delayed fracture resistance) becomes insufficient, so the number of iron-based carbides is made $4\times10^8$ (particles/mm$^3$) or more. The number is preferably $1.0\times10^9$ (particles/mm$^3$) or more, more preferably $2.0\times10^9$ (particles/mm$^3$).

The density and composition of the iron-based carbides which are contained in the steel plate of the present invention can be measured by a transmission type electron microscope (TEM) which is provided with an energy dispersion type X-ray spectrometer (EDX) or by a 3D atom probe field ion microscope (AP-FIM).

Note that, the iron-based carbides which contain Si or Si and Al which are contained in the steel plate of the present invention are several to several tens of nm in size or considerably small. For this reason, in analyzing the composition by TEM using a thin film, sometimes not only iron-based carbides, but also the Si and Al in the base phase can be simultaneously measured.

In this case, it is preferable to use AP-FIM to analyze the composition of iron-based carbides. AP-FIM can measure each atom forming an iron-based carbide, so is extremely high in precision. For this reason, it is possible to use AP-FIM to precisely measure the composition of the micro-precipitates, that is, the iron-based carbides, and the number density of the iron-based carbides.

Next, the chemical composition of the steel plate of the present invention will be explained. Note that, below, "%" means "mass %".

C: 0.07 to 0.25%

C is an element which raises the strength of the steel plate. If C is less than 0.07%, it is possible to secure a 900 MPa or higher ultimate tensile strength, while if over 0.25%, the weldability or the workability becomes insufficient, so the content is made 0.07 to 0.25%. C is preferably 0.08 to 0.24%, more preferably 0.09 to 0.23%.

Si: 0.45 to 2.50%

Al: 0.005 to 2.5%

Si and Al are elements which are extremely important for forming solid solutions in iron-based carbides and improving the hydrogen embrittlement resistance (delayed fracture resistance). The hydrogen embrittlement resistance is remarkably improved by the iron-based carbides containing Si or Si and Al in 0.1% or more.

If Si is less than 0.45%, the amount of Si in the iron-based carbides is reduced, the Si or Si and Al cannot be included in 0.1% or more, and the effect of improvement of the delayed fracture resistance becomes insufficient.

Note that, if including Al, a similar effect is obtained as the case of including Si, but if the above effect can be sufficiently obtained by including only Si, Al need not be included. However, Al acts as a deoxidizing material, 0.005% or more is added.

On the other hand, if the Si exceeds 2.50% or the Al exceeds 2.5%, the weldability or workability of the steel plate becomes insufficient, so the upper limit of Si is made 2.50% and the upper limit of Al is made 2.5%.

Si is preferably 0.40 to 2.20%, more preferably 0.50 to 2.00%. Al is preferably 0.005 to 2.0%, more preferably 0.01 to 1.6%.

Mn: 1.5 to 3.20%

Mn is an element which acts to raise the strength of steel plate. If Mn is less than 1.5%, a large amount of soft structures form in the cooling after annealing and a 900 MPa or more ultimate tensile strength becomes difficult to secure, so the lower limit is made 1.5%.

From the viewpoint of reliably securing a 900 MPa or more ultimate tensile strength, the lower limit of Mn is preferably 1.6%, more preferably 1.7%.

On the other hand, if Mn is more than 3.20%, embrittlement occurs due to segregation of Mn, the cast slab cracks, and other trouble easily occurs and, further, the weldability deteriorates, so the upper limit is made 3.20%.

From the viewpoint of preventing cracking of the slab, the upper limit of Mn is preferably 3.00%, more preferably 2.80% or less, still more preferably 2.60% or less.

P: 0.001 to 0.03%

P is an element which segregates at the center part of thickness of the steel plate and, further, causes embrittlement of the weld zone. If P exceeds 0.03%, the embrittlement of the weld zone becomes remarkable, so the upper limit is made 0.03%. To reliably avoid embrittlement of the weld zone, the content is preferably made 0.02% or less.

Reducing P to less than 0.001% is disadvantageous economically, so the lower limit is made 0.001%.

S: 0.0001 to 0.01%

S is an element which has a detrimental effect on the weldability and the manufacturability at the time of casting and the time of hot rolling. For this reason, the upper limit was made 0.01%. Reducing S to less than 0.0001% is disadvantageous economically, so the lower limit was made 0.0001%.

Note that, S bonds with Mn to form coarse MnS and lowers the bendability, so has to be reduced as much as possible.

N: 0.0001 to 0.0100%

N is an element which forms coarse nitrides and degrades the bendability and hole expandability. If N exceeds 0.0100%, the bendability and hole expandability remarkably deteriorate, so the upper limit was made 0.0100%.

Note that, N becomes a cause of blowholes at the time of welding, so is preferably small in content.

The lower limit of N does not have to be particularly set, but if reduced to less than 0.0001%, the manufacturing cost greatly increases, so 0.0001% is the substantive lower limit. N is preferably 0.0005% or more from the viewpoint of the production costs.

O: 0.0001 to 0.0080%

O is an element which forms oxides and causes deterioration of the bendability and hole expandability. In particular, oxides are often present as inclusions. If present at the punched out end faces or cut faces, notch-shaped defects or coarse dimples are formed at the end faces.

The defects or dimples become points of concentration of stress and starting points of cracking at the time of bending or strong working, so cause great deterioration of the hole expandability or bendability.

If O exceeds 0.0080%, the above tendency becomes remarkable, so the upper limit was made 0.0080%. The preferable upper limit is 0.0070%.

On the other hand, reduction of O to less than 0.0001% invites excessively higher costs and is not preferable economically, so the lower limit was made 0.0001%. The lower limit of O is preferably 0.0005%.

However, even if reducing O to less than 0.0001%, it is possible to secure a 900 MPa or more ultimate tensile strength and an excellent delayed fracture resistance.

In the steel plate of the present invention, the following elements are contained in accordance with need.

Ti: 0.005 to 0.09%

Ti is an element which contributes to raising the strength of steel plate by precipitation strengthening, strengthening by grain size reduction by suppression of growth of ferrite crystal grains, and dislocation strengthening through suppression of recrystallization. Further, Ti is an element which suppresses the formation of nitrides by B.

B is an element which contributes to structural control at the time of hot rolling and structural control and higher strength in the continuous annealing facility or continuous hot dip galvanization facility, but if B forms a nitride, this effect cannot be obtained, so Ti is added to suppress formation of nitrides by B.

However, if Ti exceeds 0.09%, the precipitation of carbonitrides becomes greater and the shapeability becomes inferior, so the upper limit is made 0.09%. On the other hand, if Ti is less than 0.005%, the effect of addition of Ti is not sufficiently obtained, so the lower limit was made 0.005%.

Ti is preferably 0.010 to 0.08%, more particularly 0.015 to 0.07%.

Nb: 0.005 to 0.09%

Nb, like Ti, is an element which contributes to raising the strength of steel plate by precipitation strengthening, strengthening by grain size reduction by suppression of growth of ferrite crystal grains, and dislocation strengthening through suppression of recrystallization.

However, if Nb exceeds 0.09%, the precipitation of carbonitrides becomes greater and the shapeability becomes inferior, so the upper limit is made 0.09%. On the other hand, if Nb is less than 0.005%, the effect of addition of Nb is not sufficiently obtained, so the lower limit was made 0.005%.

Nb is preferably 0.010 to 0.08%, more preferably 0.015 to 0.07%.

The steel plate of the present invention may contain one or more of B: 0.0001 to 0.01%, Ni: 0.01 to 2.0%, Cu: 0.01 to 2.0%, and Mo: 0.01 to 0.8%.

B: 0.0001 to 0.01%

B is an element which delays the transformation from austenite to ferrite to contribute to increased strength of the steel plate. Further, B is an element which delays the transformation from austenite to ferrite at the time of hot rolling so as to make the structure of the hot rolled plate a single phase structure of bainite and raise the uniformity of the hot rolled plate and contribute to the improvement of bendability.

If B is less than 0.0001%, the effect of addition of B is not sufficiently obtained, so the lower limit is made 0.0001%. On the other hand, if B exceeds 0.01%, not only does the effect of addition become saturated, but the manufacturability at the time of hot rolling falls, so the upper limit is made 0.01%.

B is preferably 0.0003 to 0.007%, more preferably 0.0005 to 0.0050%.

Cr: 0.01 to 2.0%

Ni: 0.01 to 2.0%

Cu: 0.01 to 2.0%

Mo: 0.01 to 0.8%

Cr, Ni, Cu, and Mo are elements which contribute to the improvement of the strength of steel plate and can be used in place of part of the Mn. In the steel plate of the present invention, it is preferable to add one or more of Cr, Ni, Cu, and Mo in respective amounts of 0.01% or more.

If the amounts of the elements exceed the upper limits of the elements, the pickling ability, weldability, hot workability, etc, deteriorate, so the upper limits of Cr, Ni, and Cu are made 2.0% and the upper limit of Mo is made 0.8%.

V: 0.005 to 0.09%

V, like Ti and Nb, is an element which contributes to raising the strength of steel plate by precipitation strengthening, strengthening by grain size reduction by suppression of growth of ferrite crystal grains, and dislocation strengthening through suppression of recrystallization. Further, V is an element which also contributes to improvement of the delayed fracture characteristics.

For this reason, when producing steel plate with an ultimate tensile strength of over 900 MPa, it is preferable to add V.

However, if V exceeds 0.09%, a greater amount of carbonitrides precipitate and the shapeability deteriorates. Further, if V is great, when running steel plate through a continuous annealing line or continuous hot dip galvanization facility, the recrystallization of ferrite is greatly delayed. After annealing, non-recrystallized ferrite remains and causes a large drop in ductility. For this reason, the upper limit of V is made 0.09%.

On the other hand, if V is less than 0.005%, the effect of addition of V becomes insufficient, so the lower limit is made 0.005%. V is preferably 0.010 to 0.08%, more preferably 0.015 to 0.07%.

The steel plate of the present invention may further contain one or more of Ca, Ce, Mg, and REM in a total of 0.0001 to 0.5%.

Ca, Ce, Mg, and REM are elements which contribute to improvement of the strength or improvement of the quality. If the total of the one or more of Ca, Ce, Mg, and REM is less than 0.0001%, a sufficient effect of addition cannot be obtained, so the lower limit of the total is made 0.0001%.

If the total of the one or more of Ca, Ce, Mg, and REM is over 0.5%, the ductility is impaired and the shapeability becomes poor, so the upper limit is made 0.5%. Note that, "REM" is an abbreviation for "rare earth metal" and indicates an element which belongs to the lanthanoids.

In the steel plate of the present invention, REM or Ce is often added by a mischmetal. Further, elements of the lanthanoids other than La or Ce are sometimes included in combination.

Even if the steel plate of the present invention contains elements of the lanthanoids other than La or Ce as impurities, the advantageous effect of the present invention is obtained. Further, even if containing metal La or Ce, the advantageous effect of the present invention is obtained.

The steel plate of the present invention includes steel plate which has a galvanized layer or a galvannealed layer at its surface. By forming a galvanized layer at the steel plate surface, excellent corrosion resistance can be secured.

Further, by forming a galvannealed layer at the steel plate surface, excellent corrosion resistance and excellent paint adhesion can be secured.

Next, the method of production of the steel plate of the present invention (hereinafter sometimes referred to as "the method of production of the present invention") will be explained.

To produce the steel plate of the present invention, first, a slab which has the above-mentioned chemical composition is cast. As the slab to be used for hot rolling, a continuously cast slab or a slab which is produced by a thin slab caster etc. may be used. The method of production of the steel plate of the present invention is compatible with a process such as continuous casting-direct rolling (CC-DR) where the steel is cast, then immediately hot rolled.

The slab heating temperature is made 1050° C. or more. If the slab heating temperature is excessively low, the final rolling temperature falls below the $Ar_3$ point and dual-phase rolling of ferrite and austenite results. The hot rolled plate structure becomes an uneven mixed grain structure.

If the structure of the hot rolled steel plate is an uneven mixed gain structure, the uneven structure is not eliminated even after cold rolling and annealing and the steel plate becomes inferior in ductility and bendability.

The steel plate of the present invention has a large amount of alloy elements added to it so as to secure a 900 MPa or more ultimate tensile strength after annealing, so the strength at the time of final rolling also tends to become higher.

Reduction of the slab heating temperature invites a drop in the final rolling temperature, invites a further increase in the rolling load, and is hard to roll or invites shape defects of the steel plate after rolling, so the slab heating temperature is made 1050° C. or more.

The upper limit of the slab heating temperature does not have to be particularly set, but excessively raising the slab heating temperature is not preferable economically, so the upper limit of the slab heating temperature is preferably made less than 1300° C.

Note that, the $Ar_3$ temperature is calculated by the following formula:

$$Ar_3=901-325\times C+33\times Si-92\times(Mn+Ni/2+Cr/2+Cu/2+Mo/2)$$

In the above formula, C, Si, Mn, Ni, Cr, Cu, and Mo are the contents (mass %) of the respective elements.

The upper limit of the final rolling temperature does not have to be particularly set, but if making the final rolling temperature excessively high, the slab heating temperature has to be made excessively high so as to secure this temperature, so the upper limit of the final rolling temperature is preferably 1000° C.

The coiling temperature is 400 to 670° C. If the coiling temperature is over 670° C., the structure of the hot rolled plate is formed with coarse ferrite or pearlite, the unevenness of the annealed structure becomes greater, and the final product deteriorates in bendability, so the upper limit is made 670° C.

Cooling at a temperature which exceeds 670° C. causes the thickness of the oxides which are formed at the steel plate surface to excessively increase and degrades the pickling ability, so this is not preferred. The coiling temperature is preferably 630° C. or less from the viewpoint of making the structure after annealing finer, raising the strength-ductility balance, and, further, improving the bendability by even dispersion of the secondary phase.

If the coiling temperature is less than 400° C., the hot rolled plate strength increases sharply and plate fracture or shape defects at the time of cold rolling are easily induced, so the lower limit of the coiling temperature is made 400° C.

Note that it is also possible to join coarse rolled plates together at the time of hot rolling for continuous final rolling. Further, the coarse rolled plated can also be coiled up once.

The thus produced hot rolled steel plate is pickled. The pickling removes the oxides from the steel plate surface, so is important for chemical conversion ability of the cold rolled high strength steel plate of the final product or improvement of the hot dip plateability of the cold rolled steel plate for hot dip galvanized or hot dip galvannealed steel plate. The pickling may be performed at one time or may be performed divided into several treatments.

The pickled hot rolled steel plate is cold rolled by a draft of 40 to 70%, then supplied to a continuous annealing line or a continuous hot dip galvanization line. If the draft is less than 40%, it becomes difficult to maintain the shape of the steel plate flat and, further, the ductility of the final product deteriorates, so the lower limit of the draft is made 40%.

If the draft exceeds 70%, the rolling load becomes too large and cold rolling becomes difficult, so the lower limit of the draft is made 70%. The draft is preferably 45 to 65%. Note that, even if not particularly prescribing the number of rolling passes and the draft for each pass, the advantageous effect of the present invention is obtained, so the number of rolling passes and the draft for each pass do not have to be prescribed.

After this, the cold rolled steel plate is run through a continuous annealing line to produce a high strength cold rolled steel plate. At this time, this is performed by the first condition which is shown below:

First Conditions

When running a cold rolled steel plate through a continuous annealing line, the cold rolled steel plate is annealed at a maximum heating temperature of 760 to 900° C., then is cooled by an average cooling rate of 1 to 1000° C./sec down to 250° C. or less, then is deformed by rolls of a radius of 800 mm or less by bending-unbending, then is heat treated in the 150 to 400° C. temperature region for 5 seconds or more.

In the method of production of the present invention, the high strength cold rolled steel plate which is obtained by running the steel through the continuous annealing line under the first conditions may be electrogalvanized and made high strength galvanized steel plate.

Further, in the method of production of the present invention, the above cold rolled steel plate may be run through the continuous hot dip galvanization line to produce high strength galvanized steel plate. In this case, the method of production of the present invention is performed under the second conditions or third conditions which are shown below.

Second Conditions

When running a cold rolled steel plate through a continuous hot dip galvanization line, the cold rolled steel plate is annealed by a maximum heating temperature of 760 to 900° C., then cooled by an average cooling rate of 1 to 1000° C./sec, then dipped in a galvanization bath, cooled by an average cooling rate of 1° C./sec or more down to 250° C. or less, then heat treated at a 150 to 400° C. temperature region for 5 sec or more.

With this method of production, it is possible to obtain high strength galvanized steel plate which is formed with a galvanized layer on the steel plate surface and which is excellent in delayed fracture resistance.

Third Conditions

When running a cold rolled steel plate through a continuous hot dip galvanization line, in the same way as the second conditions, the plate is dipped in a galvanization bath, then alloyed in a 460 to 600° C. temperature region, then cooled by an average cooling rate 1° C./sec or more down to 250° C. or less.

If performing such alloying treatment, it is possible to obtain high strength galvanized steel plate which is formed with a Zn—Fe alloy with which the galvanized layer is alloyed on the steel plate surface and therefore has an alloy or galvanized layer.

In the method of production of the present invention, the reason for making the maximum heating temperature 760 to 900° C. when rolling cold rolled steel plate through a continuous annealing line or continuous hot dip galvanization line is to make the cementite which precipitates in the hot rolled plated or the cementite which precipitates during the heating at the continuous annealing line or continuous hot dip galvanization line melt and secure a sufficient volume fraction of austenite.

If the maximum heating temperature is less than 760° C., a long time is required for melting the cementite and the productivity falls, cementite remains unmelted, the martensite volume fraction after cooling falls, and an ultimate tensile strength of 900 MPa or more can no longer be secured.

Note that, even if the maximum heating temperature exceeds 900° C., there is no problem at all in quality, but the economicalness is poor, so this is not preferred.

The residence time at the time of annealing and heating may be suitably determined in accordance with the maximum heating temperature, so does not have to be particularly limited, but 40 to 540 seconds are preferred.

In the method of production of the present invention, when running cold rolled steel plate through a continuous annealing line, after the annealing, the plate has to be cooled by an average cooling rate of 1 to 1000° C./sec down to 250° C. or less.

If the average cooling rate is less than 1° C./sec, it is not possible to suppress the formation of an excessive pearlite structure by a cooling process and possible to secure an ultimate tensile strength of 900 MPa or more.

Even if excessively raising the average cooling rate, no problem occurs at all in quality, but excessive capital investment becomes required, so the average cooling rate is preferably 1000° C./sec or less.

The reason for making the cooling end temperature by an average cooling rate of 1 to 1000° C./sec 250° C. or less is to promote the precipitation of iron-based carbides.

If the cooling end temperature exceeds 250° C., even if deforming the plate by rolls by bending-unbending after the end of the cooling, the dislocations which were introduced by the bending-unbending deformation end up being reversed and therefore precipitation of iron-based carbides becomes hard to promote.

Even if not particularly setting the lower limit of the cooling end temperature, the advantageous effect of the present invention is obtained, but it is difficult to make the cooling end temperature room temperature or less, so room temperature is the substantive lower limit.

In the method of production of the present invention, steel plate which is cooled by an average cooling rate of 1 to 1000° C./sec down to 250° C. or less is deformed by rolls of a radius of 800 mm by bending-unbending. This is to introduce dislocations in the steel plate and promote precipitation of iron-based carbides which contain Si or Al.

If the radius of the rolls is over 800 mm, it is difficult to efficiently introduce dislocations into the steel plate structure by bending-unbending deformation, so the radius of the rolls is made 800 mm or less.

By deforming the steel plate by bending-unbending, precipitation of iron-based carbides is promoted since the concern over the reduction of thickness is small.

When using rolls of a radius of 800 mm to deform cold rolled steel plate by bending-unbending, if performing this at 250° C. or less, it is possible to efficiently introduce dislocations.

Note that, in the method of production of the present invention, steel plate with an ultimate tensile strength of 900 MPa or more is produced, so plastic deformation by tensile deformation is difficult. Further, with tensile deformation, there is a concern over plate fracture due to necking etc., so bending-unbending deformation is preferable.

In the method of production of the present invention, the cold rolled steel plate is deformed by rolls of a radius of 800 mm or less by bending-unbending, then is heat treated at the 150 to 400° C. temperature region for 5 seconds or more. This causes the iron-based carbides which contain Si or Si and Al to precipitate in large amounts.

In the method of production of the present invention, when running cold rolled steel plate through a continuous hot dip galvanization facility, in the same way as running it through a continuous annealing line, the cold rolled steel plate is annealed at a maximum heating temperature of 760 to 900° C., then is cooled by an average cooling rate of 1 to 1000° C./second, then is dipped in a hot dip galvanization bath, then is cooled by an average cooling rate of 1° C./sec or more down to 250° C. or less.

Due to this method, it is possible to obtain hot dip plated steel plate. Note that, the temperature of the galvanization bath is preferably 440 to 480° C.

In the method of production of the present invention, when running cold rolled steel plate through a continuous hot dip galvanization facility, the plate may be dipped in a galvanization bath, then alloyed at a 460 to 600° C. temperature region, then cooled by an average cooling rate of 1° C./sec or more down to 250° C. or less.

By this method, it is possible to obtain high strength galvanized steel plate which has a galvanized layer alloyed with the steel plate surface. By making the steel plate a hot dip galvanized steel plate or galvannealed steel plate, it is possible to raise the rustproofness of steel plate.

In the embodiment of the present invention, as explained above, the atmosphere in the annealing furnace of the continuous annealing line or continuous hot dip galvanization line at the time of production of high strength cold rolled steel plate or high strength galvanized steel plate is made an atmosphere which contains $H_2$ in 1 to 60 vol % and has a balance of $N_2$, $H_2O$, $O_2$, and unavoidable impurities.

Further, the logarithm log $(P_{H2O}/P_{H2})$ of the water partial pressure and the hydrogen partial pressure in the above atmosphere is preferably made $$-3 \leq \log (P_{H2O}/P_{H2}) \leq -0.5$$

If the atmosphere in the annealing furnace is made the above atmosphere, before the Si, Mn, and Al which are contained in the steel plate are diffused in the steel plate surface, the O which diffuses inside of the steel plate and the Si, Mn, and Al inside of the steel plate react whereby oxides are formed inside of the steel plate and these oxides are kept from being formed at the steel plate surface.

Therefore, by making the atmosphere in the annealing furnace the above atmosphere, it is possible to suppress the occurrence of non-plating due to formation of oxides at the steel plate surface, possible to promote an alloying reaction, and possible to prevent deterioration of the chemical conversion ability due to formation of oxides.

Note that, the ratio of the water partial pressure and the hydrogen partial pressure in the atmosphere in the annealing furnace can be adjusted by the method of blowing steam into the annealing furnace. In this way, the method of adjusting the ratio of the water partial pressure and the hydrogen partial pressure in the atmosphere in the annealing furnace is simple and preferable.

In the atmosphere in the annealing furnace, if the $H_2$ concentration exceeds 60 vol %, higher costs are invited, so this is not preferred. If the $H_2$ concentration becomes less than 1 vol %, the Fe which is contained in the steel plate oxidizes and the wettability or plating adhesion of the steel plate is liable to become insufficient.

If making the logarithm log $(P_{H2O}/P_{H2})$ of the water partial pressure and the hydrogen partial pressure in the atmosphere in the annealing furnace $$-3 \leq \log (P_{H2O}/P_{H2}) \leq -0.5$$

sufficient plateability can be secured even with steel which contains a large amount of Si.

The reason for making the lower limit of the logarithm log $(P_{H2O}/P_{H2})$ of the water partial pressure and the hydrogen partial pressure −3 is that, if less than −3, the ratio of formation of Si oxides (or Si oxides and Al oxides) on the steel plate surface becomes greater and the wettability or plating adhesion falls.

The reason for making the upper limit of the logarithm log $(P_{H2O}/P_{H2})$ of the water partial pressure and the hydrogen partial pressure −0.5 is that even if $P_{H2O}/P_{H2}$ is prescribed as being over −0.5, the effect become saturated.

As opposed to this, for example, by not making the atmosphere inside of the annealing furnace the above atmosphere and running the cold rolled steel plate through a continuous annealing line or continuous hot dip galvanization line, the problem which is shown below occurs.

In the method of production of the present invention, to raise the ferrite volume rate and secure ductility, a slab which contains Si (or Si and Al) and includes Mn which raises the steel plate strength is used.

Si, Mn, and Al are elements which oxidize extremely easily compared with Fe, so even in an Fe reducing atmosphere, the surface of steel plate which contains Si (or Si and Al) and Mn is formed with Si oxides (or Si oxides and Al oxides) and Mn oxides.

Oxides which contain Si, Mn, or Al alone and/or oxides which contain Si, Mn, and Al compositely which are present at the surface of steel plate become the cause of deterioration of the chemical conversion ability of steel plate.

Further, these oxides are poor in wettability with zinc and other molten metals, so become causes of non-plating occurring at the surface of steel plate which contains Si (or Si and Al).

Furthermore, Si and Al sometimes cause problems such as delay of alloying when producing galvanized steel plate which has been alloyed.

As opposed to this, if making the atmosphere in the annealing furnace the above atmosphere, while an Fe reducing atmosphere, Si, Mn, and Al are easily oxidized, so as explained above, oxides of Si, Mn, and Al are formed inside the steel plate and formation of oxides at the steel plate surface is suppressed.

In the method of production of the present invention, a slab having a predetermined chemical composition is cast, the cold rolled steel plate is annealed at a predetermined temperature and cooled by a predetermined average cooling rate down to 250° C. or less, then the plate is deformed by rolls of a radius of 800 mm or less by bending-unbending and then heat treated at a 150 to 400° C. temperature region for 5 sec or more, so it is possible to make $4\times10^8$ (particles/$mm^3$) or more iron-based carbides which contain "Si" or "Si and Al" precipitate in 0.1% or more. As a result, it is possible to produce high strength steel plate which has an ultimate tensile strength of 900 MPa or more and has an excellent shapeability and hydrogen embrittlement resistance.

In the method of production of the present invention, when producing high strength cold rolled steel plate or high strength galvanized steel plate, the water partial pressure and the hydrogen partial pressure are adjusted to control the atmosphere inside the annealing furnace, but the method of controlling the partial pressures of carbon dioxide and carbon monoxide or the method of directly blowing oxygen into the furnace may be used to control the atmosphere inside the annealing furnace.

In this case as well, in the same way as adjusting the water partial pressure and the hydrogen partial pressure to control the atmosphere in the annealing furnace, it is possible to cause the precipitation of oxides which contain Si, Mn, or Al alone and/or oxides which contain Si, Mn, and Al compositely inside the steel plate near the surface layer and possible to obtain similar effects to the effects explained above.

In the method of production of the present invention, when producing high strength galvanized steel plate, to improve the plating adhesion, it is also possible to plate the steel plate before annealing with one or more elements selected from Ni, Cu, Co, and Fe.

Further, in the method of production of the present invention, when producing high strength galvanized steel plating, as the method from annealing to dipping in a galvanization bath, any of the following methods may be employed.

(a) The Sendimir method of "degreasing, pickling, then heating in a nonoxidizing atmosphere, annealing by a reducing atmosphere which contains $H_2$ and $N_2$, then cooling to near the galvanization bath temperature and dipping in a galvanization bath."

(b) The total reduction furnace method of "adjusting the atmosphere at the time of annealing to make the steel plate surface first oxidize, then using reduction to clean the steel plate surface before plating, then dipping in a galvanization bath"

(c) The flux method of "degreasing and pickling the steel plate, then using ammonium chloride etc. for flux treatment, then dipping in a galvanization bath"

In the method of production of the present invention, when running the cold rolled steel plate through a continuous annealing line (or continuous hot dip galvanization line) to produce high strength cold rolled steel plate (or high strength galvanized steel plate), it is possible to make the cooling end temperature at an average cooling rate of 1 to 1000° C./sec the Ms point to the Ms point −100° C.

By this method, it is possible to produce high strength steel plate which has iron-based carbides which contain Si or Si and Al in 0.1% or more and which has a steel plate structure having, by volume fraction, ferrite: 10 to 50%, bainitic ferrite and/or bainite: 10 to 60%, tempered martensite: 10 to 50%, fresh martensite: 10% or less, and preferably retained austenite: 2 to 25%.

Note that, the Ms point is calculated by the following formula:

$$\text{Ms point [° C.]}=561-474C/(1-VF)-33Mn-17Cr-17Ni-5Si+19Al$$

In the above formula, VF indicates the volume fraction of ferrite, while C, Mn, Cr, Ni, Si, and Al are the amounts of addition of these elements [mass %].

Note that, during the production of steel plate, it is difficult to directly measure the volume fraction of ferrite, so when determining the Ms point, a small piece of the cold rolled steel plate is cut out before being run through the continuous annealing line, the small piece is annealed by the same temperature history as the case of running the small piece through the continuous annealing line, the volume of ferrite of the small piece is measured, and the result is used to calculate a value which is then made the volume fraction VF of the ferrite.

In the above method of production, the obtained cold rolled steel plate is annealed by a maximum heating temperature of 760 to 900° C. Due to this annealing, a sufficient volume fraction of austenite can be secured.

If the maximum heating temperature is less than 760° C., the amount of austenite becomes insufficient and it is possible to secure a sufficient amount of hard structures by phase transformation during the cooling after that. On this point, the maximum heating temperature is made 760° C. or more.

If the maximum heating temperature exceeds 900° C., the particle size of the austenite becomes coarse and transformation becomes harder during cooling. In particular, it is difficult to sufficiently obtain a soft ferrite structure.

The cold rolled steel plate is annealed at the maximum heating temperature, then cooled by an average cooling rate of 1 to 1000° C./sec to the Ms point to the Ms point −100° C. (cooling end temperature) (when running it through the continuous hot dip galvanization line, the plate is cooled by an average cooling rate of 1 to 1000° C./sec, then dipped in a galvanization bath and cooled by an average cooling rate of 1° C./sec or more down to the Ms point to the Ms point −100° C.)

If the average cooling rate is less than 1° C./sec, the ferrite transformation proceeds excessively, the non-transformed austenite is reduced, and sufficient hard structures cannot be obtained. If the average cooling rate exceeds 1000° C./sec, it is not possible to sufficiently generate soft ferrite structures.

If the cooling end temperature is the Ms point to the Ms point −100° C., it is possible to accelerate the martensite transformation of the untransformed austenite. If the cooling end temperature is over the Ms point, martensite is not formed.

If the cooling end temperature is less than the Ms point −100° C., the majority of the untransformed austenite becomes martensite and a sufficient amount of bainite cannot be obtained. To leave behind a sufficient amount of untransformed austenite, the cooling end temperature is preferably the Ms point −80° C. or more, more preferably the Ms point −60° C. or more.

The steel plate is cooled to the Ms point to the Ms point −100° C., the plate is deformed by bending-unbending, then heat treatment is performed at 150 to 400° C. in temperature region for 5 sec or more. Due to this heat treatment, it is possible to obtain a steel plate structure which contains iron-based carbides which contains Si or Si and Al in a total of 0.1% or more and low temperature martensite with a dislocation density of $10^{14}/m^2$ or more.

EXAMPLES

Next, examples of the present invention will be explained, but the conditions under the examples are an illustration of conditions employed for confirming the workability and effects of the present invention. The present invention is not limited to this illustration of conditions. The present invention can employ various conditions so long as achieving the object of the present invention without departing from the gist of the present invention.

Example 1

Slabs of the chemical compositions of A to Y which are shown in Table 1 and Table 2 were cast, then, immediately after casting, were hot rolled under the conditions which are shown in Table 3 and Table 4 (slab heating temperature and hot rolling end temperature). Next, the hot rolled steel plates were coiled at the coiling temperatures which are shown in Table 3 and Table 4. After this, the hot rolled steel plates were pickled and were cold rolled by the drafts which are shown in Table 3 and Table 4 so as to obtain 1.6 mm thick cold rolled steel plates (in Table 3 and Table 4, see Experimental Examples 1 to 56).

TABLE 1

| Exp. ex. | C mass % | Si mass % | Mn mass % | P mass % | S mass % | Al mass % | N mass % | O mass % |
|---|---|---|---|---|---|---|---|---|
| A | 0.074 | 0.71 | 2.39 | 0.007 | 0.0011 | 0.042 | 0.0034 | 0.0014 |
| B | 0.086 | 0.32 | 2.35 | 0.013 | 0.0008 | 0.002 | 0.0014 | 0.0009 |
| C | 0.12 | 1.97 | 2.01 | 0.011 | 0.0016 | 0.024 | 0.0022 | 0.0011 |
| D | 0.147 | 1.19 | 1.94 | 0.01 | 0.0016 | 0.027 | 0.0024 | 0.0015 |
| E | 0.149 | 0.33 | 2.19 | 0.012 | 0.0034 | 0.72 | 0.0021 | 0.0021 |
| F | 0.164 | 1.34 | 2.01 | 0.011 | 0.0021 | 0.033 | 0.0017 | 0.0014 |
| G | 0.102 | 0.42 | 2.11 | 0.012 | 0.0019 | 0.027 | 0.0024 | 0.0017 |
| H | 0.152 | 0.76 | 2.11 | 0.008 | 0.0021 | 0.031 | 0.0026 | 0.0019 |
| I | 0.152 | 0.42 | 2.24 | 0.007 | 0.0023 | 0.004 | 0.0016 | 0.0029 |
| J | 0.182 | 0.55 | 1.78 | 0.011 | 0.0022 | 0.034 | 0.0022 | 0.0012 |
| K | 0.179 | 0.42 | 2.14 | 0.009 | 0.0019 | 0.035 | 0.0025 | 0.0019 |
| L | 0.181 | 0.4 | 2.41 | 0.015 | 0.0034 | 0.038 | 0.0019 | 0.0015 |
| M | 0.178 | 0.76 | 2.42 | 0.014 | 0.0036 | 0.041 | 0.0027 | 0.0018 |
| N | 0.182 | 0.79 | 2.39 | 0.009 | 0.0024 | 0.019 | 0.0022 | 0.0011 |
| O | 0.179 | 0.42 | 2.37 | 0.013 | 0.0023 | 0.068 | 0.0028 | 0.0022 |
| P | 0.18 | 0.58 | 2.45 | 0.001 | 0.0026 | 0.098 | 0.0044 | 0.0019 |
| Q | 0.213 | 0.72 | 2.38 | 0.0012 | 0.0029 | 0.017 | 0.0019 | 0.0011 |
| R | 0.0034 | 0.44 | 2.13 | 0.009 | 0.0024 | 0.033 | 0.0024 | 0.0019 |
| S | 0.429 | 0.74 | 2.13 | 0.007 | 0.0011 | 0.027 | 0.0022 | 0.0016 |
| T | 0.142 | 0.13 | 2.19 | 0.023 | 0.0027 | 0.033 | 0.0025 | 0.0019 |
| U | 0.155 | 2.88 | 2.21 | 0.016 | 0.0033 | 0.024 | 0.0029 | 0.002 |
| V | 0.142 | 0.41 | 1.44 | 0.012 | 0.0038 | 0.008 | 0.0034 | 0.0026 |
| W | 0.169 | 0.32 | 5.61 | 0.014 | 0.003 | 0.29 | 0.0034 | 0.0019 |
| X | 0.112 | 0.46 | 2.09 | 0.016 | 0.0021 | 2.68 | 0.0019 | 0.0017 |
| Y | 0.357 | 0.74 | 2.99 | 0.015 | 0.0027 | 0.033 | 0.0022 | 0.0016 |

Underlines show outside scope of present invention

TABLE 2

| Exp. ex. | Ti mass % | Nb mass % | B mass % | Cr mass % | Ni mass % | Cu mass % | Mo mass % | V mass % | Ca mass % | Ce mass % | Mg mass % | REM mass % | Remarks |
|---|---|---|---|---|---|---|---|---|---|---|---|---|---|
| A | | | | | | | | | | | | | Inv. ex. |
| B | 0.011 | | 0.0006 | | | | | | | | | | Inv. ex. |
| C | | | | | | | | | | | | | Inv. ex. |
| D | 0.021 | 0.019 | 0.0037 | | | | | | | | | | Inv. ex. |
| E | 0.033 | | | | | | | | | | | | Inv. ex. |
| F | 0.046 | | 0.0018 | | | | | | | | | | Inv. ex. |
| G | 0.017 | 0.039 | 0.0024 | 0.68 | | | | | | | | | Inv. ex. |
| H | 0.062 | | 0.0014 | 0.12 | | | | | | | | | Inv. ex. |
| I | | | | | 0.24 | 0.12 | | | | | | | Inv. ex. |
| J | | | | | | | 0.14 | | | | | | Inv. ex. |
| K | | | | | | | | 0.083 | | | | | Inv. ex. |
| L | | | | | | | | | 0.0006 | | | | Inv. ex. |
| M | | | | | | | | | | 0.0013 | | | Inv. ex. |
| N | | | | | | | | | | | 0.0007 | | Inv. ex. |
| O | | | | | | | | | | | | 0.0004 | Inv. ex. |
| P | | | | | | | | | | | | | Inv. ex. |
| Q | 0.068 | | 0.0013 | | | | | | | | | | Inv. ex. |
| R | | | | | | | | | | | | | Comp. ex. |
| S | | | | | | | | | | | | | Comp. ex. |
| T | | | 0.0046 | | | | | | | | | | Comp. ex. |
| U | 0.034 | | 0.0009 | | | | | | | | | | Comp. ex. |
| V | | | | | | | | | | | | | Comp. ex. |
| W | | | | | | | | | | | | | Comp. ex. |
| X | | | | | | | | | | | | | Comp. ex. |
| Y | | | | | | | | | | | | | Comp. ex. |

Underlines show outside scope of present invention

TABLE 3

| Exp. ex. | Chemical Compositions | Steel type*1 | Slab heating temp. ° C. | $Ar_3$ trans. point ° C. | Hot rolling end temp. ° C. | Coiling temp. ° C. | Draft % | Remarks |
|---|---|---|---|---|---|---|---|---|
| 1 | A | CR | 1180 | 681 | 920 | 560 | 60 | Inv. ex. |
| 2 | A | CR | 1200 | 681 | 880 | 620 | 60 | Comp. ex. |
| 3 | A | CR | 1180 | 681 | 860 | 580 | 60 | Comp. ex. |
| 4 | A | CR | 1190 | 681 | 920 | 600 | 60 | Comp. ex. |

TABLE 3-continued

| Exp. ex. | Chemical Compositions | Steel type*1 | Slab heating temp. ° C. | $Ar_3$ trans. point ° C. | Hot rolling end temp. ° C. | Coiling temp. ° C. | Draft % | Remarks |
|---|---|---|---|---|---|---|---|---|
| 5 | A | CR | 1240 | 681 | 940 | 610 | 60 | Comp. ex. |
| 6 | A | CR | 1200 | 681 | 930 | 620 | 60 | Comp. ex. |
| 7 | A | CR | 1210 | 681 | 910 | 590 | 60 | Comp. ex. |
| 8 | A | EG | 1220 | 681 | 920 | 590 | 60 | Inv. ex. |
| 9 | B | CR | 1210 | 681 | 940 | 540 | 60 | Inv. ex. |
| 10 | B | CR | 1230 | 667 | 920 | 530 | 60 | Comp. ex. |
| 11 | B | CR | 1190 | 667 | 900 | 570 | 60 | Comp. ex. |
| 12 | B | CR | 1220 | 667 | 880 | 540 | 60 | Comp. ex. |
| 13 | B | CR | 1210 | 667 | 890 | 580 | 60 | Comp. ex. |
| 14 | B | CR | 1190 | 667 | 920 | 560 | 60 | Comp. ex. |
| 15 | B | EG | 1230 | 667 | 830 | 540 | 60 | Inv. ex. |
| 16 | C | CR | 1170 | 742 | 900 | 650 | 70 | Inv. ex. |
| 17 | C | CR | 1190 | 742 | 880 | 640 | 70 | Comp. ex. |
| 18 | C | CR | 1210 | 742 | 940 | 620 | 70 | Comp. ex. |
| 19 | C | CR | 1230 | 742 | 910 | 610 | 70 | Comp. ex. |
| 20 | C | EG | 1210 | 742 | 900 | 590 | 70 | Inv. ex. |
| 21 | D | GI | 1240 | 714 | 910 | 610 | 48 | Inv. ex. |
| 22 | D | GA | 1240 | 714 | 920 | 590 | 48 | Inv. ex. |
| 23 | D | GA | 1230 | 714 | 930 | 620 | 48 | Comp. ex. |
| 24 | D | GA | 1220 | 714 | 920 | 540 | 48 | Comp. ex. |
| 25 | D | GA | 1270 | 714 | 900 | 560 | 48 | Comp. ex. |
| 26 | D | GA | 1230 | 714 | 890 | 510 | 48 | Comp. ex. |
| 27 | D | GA | 1240 | 714 | 930 | 500 | 48 | Comp. ex. |
| 28 | D | GA | 1230 | 714 | 890 | 560 | 48 | Comp. ex. |
| 29 | E | GA | 1250 | 662 | 950 | 540 | 52 | Inv. ex. |

Underlines show outside scope of present invention

*1CR: cold rolled steel plate, EG: electrogalvanized steel plate, GI: hot dip galvanized steel plate, GA: hot dip galvannealed steel plate

TABLE 4

| Exp. ex. | Chemical Compositions | Steel type*1 | Slab heating temp. ° C. | $Ar_3$ trans. point ° C. | Hot rolling end temp. ° C. | Coiling temp. ° C. | Draft % | Remarks |
|---|---|---|---|---|---|---|---|---|
| 30 | E | GA | 1260 | 662 | 900 | 500 | 52 | Comp. ex. |
| 31 | E | GA | 1220 | 662 | 890 | 510 | 52 | Comp. ex. |
| 32 | E | GA | 1230 | 662 | 920 | 560 | 52 | Comp. ex. |
| 33 | E | GA | 1220 | 662 | 960 | 540 | 52 | Comp. ex. |
| 34 | F | EG | 1260 | 707 | 960 | 530 | 52 | Inv. ex. |
| 35 | G | GA | 1230 | 656 | 930 | 570 | 52 | Inv. ex. |
| 36 | G | GA | 1210 | 656 | 900 | 530 | 52 | Comp. ex. |
| 37 | G | GA | 1230 | 656 | 910 | 560 | 52 | Comp. ex. |
| 38 | G | GA | 1240 | 656 | 930 | 550 | 52 | Comp. ex. |
| 39 | H | GA | 1250 | 677 | 920 | 490 | 48 | Inv. ex. |
| 40 | I | GA | 1190 | 643 | 970 | 620 | 60 | Inv. ex. |
| 41 | J | GA | 1200 | 690 | 900 | 440 | 60 | Inv. ex. |
| 42 | K | GI | 1210 | 660 | 890 | 560 | 52 | Inv. ex. |
| 43 | L | GA | 1190 | 634 | 880 | 590 | 60 | Inv. ex. |
| 44 | M | GI | 1200 | 646 | 910 | 550 | 60 | Inv. ex. |
| 45 | N | GA | 1180 | 648 | 870 | 620 | 60 | Inv. ex. |
| 46 | O | GI | 1220 | 639 | 920 | 610 | 60 | Inv. ex. |
| 47 | P | GA | 1230 | 636 | 930 | 570 | 60 | Inv. ex. |
| 48 | Q | GA | 1260 | 637 | 910 | 540 | 48 | Inv. ex. |
| 49 | R | GA | 1220 | 718 | 900 | 530 | 52 | Comp. ex. |
| 50 | S | GA | 1230 | 590 | 920 | 590 | 40 | Comp. ex. |
| 51 | T | GA | 1200 | 658 | 950 | 550 | 66 | Comp. ex. |
| 52 | U | GA | 1240 | 742 | 930 | 560 | 40 | Comp. ex. |
| 53 | V | GA | 1200 | 736 | 940 | 480 | 60 | Comp. ex. |
| 54 | W | GA | 1190 | 341 | 900 | 510 | 40 | Comp. ex. |
| 55 | X | GA | 1200 | 688 | 920 | 500 | 60 | Comp. ex. |
| 56 | Y | GA | 1180 | 534 | 910 | 600 | 40 | Comp. ex. |

Underlines show outside scope of present invention

*1CR: cold rolled steel plate, EG: electrogalvanized steel plate, GI: hot dip galvanized steel plate, GA: hot dip galvannealed steel plate The cold rolled steel plates of Experimental Examples 1 to 56 which are shown in Table 3 and Table 4 were run through a continuous annealing line or continuous hot dip galvanization line to produce the steel plates of Experimental Examples 1 to 56 which are shown in Table 3 to Table 8 (cold rolled steel plate (CR), electrogalvanized steel plates (EG), hot dip galvanized steel plates (GI), and hot dip galvannealed steel plates (GA)).

When running the cold rolled steel plates through the continuous annealing line, they were annealed by the maximum heating temperatures which are shown in Table 5 and Table 6, then cooled by average cooling rates which are shown in Table 5 and Table 6 down to the cooling end temperatures which are shown in Table 5 and Table 6, then deformed by rolls of radii which are shown in Table 5 and Table 6 for bending-unbending, then heat treated by the heat treatment temperatures and times which are shown in Table 5 and Table 6.

TABLE 5

| Exp. ex. | Chemical Compositions | Steel type*1 | Resid. time at annealing heating Sec | Max. heating temp. ° C. | Average cooling rate ° C./sec | Cooling end temp. ° C. | Roll radius mm | Heat treat. temp. ° C. | Heat treat. time Sec | Galv. bath temp. ° C. | Alloying temp. ° C. | Remarks |
|---|---|---|---|---|---|---|---|---|---|---|---|---|
| 1 | A | CR | 120 | 820 | 9 | 240 | 600 | 330 | 600 | —*2 | —*2 | Inv. ex. |
| 2 | A | CR | 120 | 810 | 9 | 200 | 600 | —*2 | 600 | —*2 | —*2 | Comp. ex. |
| 3 | A | CR | 120 | 720 | 7 | 170 | 600 | 280 | 600 | —*2 | —*2 | Comp. ex. |
| 4 | A | CR | 120 | 820 | 9 | 330 | 600 | 260 | 600 | —*2 | —*2 | Comp. ex. |
| 5 | A | CR | 120 | 830 | 130 | 240 | 900 | 180 | 600 | —*2 | —*2 | Comp. ex. |
| 6 | A | CR | 120 | 840 | 10 | 240 | 600 | 120 | 600 | —*2 | —*2 | Comp. ex. |
| 7 | A | CR | 120 | 810 | 10 | 160 | 600 | 490 | 600 | —*2 | —*2 | Comp. ex. |
| 8 | A | EG | 120 | 830 | 9 | 200 | 600 | 290 | 600 | —*2 | —*2 | Inv. ex. |
| 9 | B | CR | 240 | 880 | 9 | 210 | 600 | 290 | 330 | —*2 | —*2 | Inv. ex. |
| 10 | B | CR | 240 | 710 | 8 | 200 | 600 | 300 | 330 | —*2 | —*2 | Comp. ex. |
| 11 | B | CR | 240 | 870 | 9 | 460 | 600 | 260 | 330 | —*2 | —*2 | Comp. ex. |
| 12 | B | CR | 240 | 860 | 9 | 230 | 900 | 250 | 330 | —*2 | —*2 | Comp. ex. |
| 13 | B | CR | 240 | 880 | 9 | 200 | 600 | 90 | 330 | —*2 | —*2 | Comp. ex. |
| 14 | B | CR | 240 | 880 | 9 | 210 | 600 | 440 | 330 | —*2 | —*2 | Comp. ex. |
| 15 | B | EG | 240 | 860 | 9 | 180 | 600 | 300 | 330 | —*2 | —*2 | Inv. ex. |
| 16 | C | CR | 120 | 840 | 10 | 180 | 600 | 290 | 200 | —*2 | —*2 | Inv. ex. |
| 17 | C | CR | 120 | 850 | 10 | 220 | 900 | 300 | 200 | —*2 | —*2 | Comp. ex. |
| 18 | C | CR | 120 | 840 | 10 | 180 | 600 | 110 | 200 | —*2 | —*2 | Comp. ex. |
| 19 | C | CR | 120 | 840 | 10 | 160 | 600 | 480 | 200 | —*2 | —*2 | Comp. ex. |
| 20 | C | EG | 120 | 830 | 10 | 180 | 600 | 290 | 200 | —*2 | —*2 | Inv. ex. |
| 21 | D | GI | 60 | 840 | 3 | 40 | 450 | 300 | 6 | 450 | —*2 | Inv. ex. |
| 22 | D | GA | 60 | 850 | 3 | 40 | 450 | 260 | 12 | 440 | 530 | Inv. ex. |
| 23 | D | GA | 60 | 830 | 3 | 460 | 450 | 540 | 12 | 450 | 540 | Comp. ex. |
| 24 | D | GA | 60 | 840 | 3 | 35 | 900 | 280 | 12 | 460 | 530 | Comp. ex. |
| 25 | D | GA | 60 | 850 | 3 | 50 | 450 | 50 | 12 | 440 | 520 | Comp. ex. |
| 26 | D | GA | 60 | 840 | 3 | 40 | 450 | 500 | 12 | 450 | 490 | Comp. ex. |
| 27 | D | GA | 60 | 740 | 3 | 40 | 450 | 280 | 12 | 450 | 520 | Comp. ex. |
| 28 | D | GA | 60 | 860 | 0.3 | 50 | 450 | 250 | 12 | 440 | 560 | Comp. ex. |
| 29 | E | GA | 80 | 810 | 3 | 30 | 450 | 310 | 24 | 460 | 490 | Inv. ex. |

Underlines show outside scope of present invention

*1CR: cold rolled steel plate, EG: electrogalvanized steel plate, GI: hot dip galvanized steel plate, GA: hot dip galvannealed steel plate

*2Steps not performed

TABLE 6

| Exp. ex. | Chemical Compositions | Steel type*1 | Resid. time at annealing heating Sec | Max. heating temp. ° C. | Average cooling rate ° C./sec | Cooling end temp. ° C. | Roll radius mm | Heat treat. temp. ° C. | Heat treat. time Sec | Galv. bath temp. ° C. | Alloying temp. ° C. | Remarks |
|---|---|---|---|---|---|---|---|---|---|---|---|---|
| 30 | E | GA | 80 | 800 | 3 | 40 | 900 | 250 | 24 | 460 | 520 | Comp. ex. |
| 31 | E | GA | 80 | 810 | 3 | 40 | 450 | 120 | 24 | 450 | 560 | Comp. ex. |
| 32 | E | GA | 80 | 720 | 3 | 40 | 450 | 250 | 24 | 450 | 520 | Comp. ex. |
| 33 | E | GA | 80 | 810 | 0.3 | 40 | 450 | 310 | 24 | 450 | 550 | Comp. ex. |
| 34 | F | EG | 40 | 840 | 3 | 180 | 450 | 280 | 5 | —*2 | —*2 | Inv. ex. |
| 35 | G | GA | 120 | 890 | 2 | 40 | 600 | 300 | 8 | 450 | 520 | Inv. ex. |
| 36 | G | GA | 120 | 860 | 2 | 40 | 800 | 300 | 8 | 460 | 540 | Comp. ex. |
| 37 | G | GA | 120 | 880 | 2 | 40 | 450 | 120 | 8 | 450 | 540 | Comp. ex. |
| 38 | G | GA | 120 | 890 | 0.3 | 40 | 450 | 280 | 8 | 450 | 540 | Comp. ex. |
| 39 | H | GA | 40 | 780 | 3 | 40 | 600 | 300 | 8 | 440 | 580 | Inv. ex. |
| 40 | I | GA | 120 | 790 | 3 | 30 | 600 | 290 | 8 | 440 | 560 | Inv. ex. |
| 41 | J | GA | 120 | 800 | 3 | 50 | 600 | 260 | 16 | 460 | 540 | Inv. ex. |
| 42 | K | GI | 120 | 810 | 3 | 30 | 600 | 300 | 16 | 450 | —*2 | Inv. ex. |
| 43 | L | GA | 120 | 820 | 3 | 50 | 600 | 260 | 16 | 460 | 490 | Inv. ex. |
| 44 | M | GI | 120 | 810 | 3 | 30 | 600 | 310 | 16 | 470 | —*2 | Inv. ex. |
| 45 | N | GA | 120 | 780 | 3 | 40 | 600 | 260 | 16 | 460 | 540 | Inv. ex. |
| 46 | O | GI | 120 | 830 | 3 | 50 | 600 | 290 | 16 | 460 | —*2 | Inv. ex. |
| 47 | P | GA | 120 | 810 | 3 | 30 | 600 | 290 | 16 | 440 | 550 | Inv. ex. |
| 48 | Q | GA | 540 | 870 | 3 | 40 | 600 | 320 | 24 | 460 | 540 | Inv. ex. |
| 49 | R | GA | 120 | 820 | 3 | 30 | 600 | 280 | 6 | 480 | 580 | Comp. ex. |
| 50 | S | CR | 320 | 870 | 10 | 160 | 600 | 250 | 6 | —*2 | —*2 | Comp. ex. |
| 51 | T | GA | 120 | 780 | 3 | 30 | 600 | 250 | 5 | 460 | 520 | Comp. ex. |
| 52 | U | GA | 120 | 820 | 3 | 50 | 600 | 270 | 10 | 450 | 540 | Comp. ex. |

TABLE 6-continued

| Exp. ex. | Chemical Compositions | Steel type*1 | Resid. time at annealing heating Sec | Max. heating temp. ° C. | Average cooling rate ° C./sec | Cooling end temp. ° C. | Roll radius mm | Heat treat. temp. ° C. | Heat treat. time Sec | Galv. bath temp. ° C. | Alloying temp. ° C. | Remarks |
|---|---|---|---|---|---|---|---|---|---|---|---|---|
| 53 | V | GA | 120 | 790 | 3 | 40 | 600 | 320 | 24 | 450 | 560 | Comp. ex. |
| 54 | W | GA | 380 | 860 | 3 | 30 | 600 | 290 | 16 | 440 | 590 | Comp. ex. |
| 55 | X | GA | 120 | 790 | 3 | 40 | 600 | 300 | 16 | 440 | 540 | Comp. ex. |
| 56 | Y | GA | 400 | 880 | 3 | 30 | 600 | 300 | 24 | 460 | 550 | Comp. ex. |

Underlines show outside scope of present invention

*1CR: cold rolled steel plate, EG: electrogalvanized steel plate, GI: hot dip galvanized steel plate, GA: hot dip galvannealed steel plate

*2Steps not performed

TABLE 7

| Exp. ex. | Chemical Compositions | Steel type*1 | Number density of iron-based carbides particles/mm$^3$ | Content of Si or Si + Al mass % | Volume rate F | Volume rate B | Volume rate M | Balance structure | Hydrogen embrittlement resistance | TS MPa | Remarks |
|---|---|---|---|---|---|---|---|---|---|---|---|
| 1 | A | CR | $2.4 \times 10^9$ | 0.22 | 54 | 3 | 41 | — | Good | 1012 | Inv. ex. |
| 2 | A | CR | $8.2 \times 10^6$ | 0.23 | 52 | 4 | 40 | A(4) | x | 1316 | Comp. ex. |
| 3 | A | CR | $1.1 \times 10^6$ | 0 | 92 | 0 | 0 | C(8) | Good | 723 | Comp. ex. |
| 4 | A | CR | $6.8 \times 10^7$ | 0.19 | 54 | 16 | 26 | A(4) | x | 967 | Comp. ex. |
| 5 | A | CR | $3.6 \times 10^7$ | 0.22 | 53 | 6 | 36 | A(5) | x | 1009 | Comp. ex. |
| 6 | A | CR | $1.2 \times 10^7$ | 0.22 | 55 | 1 | 43 | A(1) | x | 1043 | Comp. ex. |
| 7 | A | CR | $3.3 \times 10^8$ | 0 | 55 | 2 | 43 | — | Good | 823 | Comp. ex. |
| 8 | A | CR | $2.6 \times 10^9$ | 0.22 | 55 | 4 | 41 | — | Good | 1017 | Inv. ex. |
| 9 | B | CR | $4.6 \times 10^9$ | 0.11 | 0 | 24 | 76 | — | Good | 1015 | Inv. ex. |
| 10 | B | CR | $2.4 \times 10^6$ | 0 | 91 | 0 | 0 | C(9) | Good | 745 | Comp. ex. |
| 11 | B | CR | $2.5 \times 10^7$ | 0.11 | 0 | 74 | 24 | A(2) | x | 956 | Comp. ex. |
| 12 | B | CR | $7.2 \times 10^7$ | 0.1 | 0 | 23 | 77 | — | x | 1086 | Comp. ex. |
| 13 | B | CR | $1.3 \times 10^7$ | 0.12 | 0 | 24 | 76 | — | x | 1146 | Comp. ex. |
| 14 | B | CR | $2.0 \times 10^8$ | 0 | 0 | 26 | 74 | — | Good | 824 | Comp. ex. |
| 15 | B | EG | $3.9 \times 10^9$ | 0.11 | 0 | 73 | 27 | — | Good | 1022 | Inv. ex. |
| 16 | C | CR | $2.3 \times 10^9$ | 0.61 | 72 | 3 | 23 | A(2) | Good | 999 | Inv. ex. |
| 17 | C | CR | $6.9 \times 10^7$ | 0.59 | 73 | 1 | 24 | A(2) | x | 1006 | Comp. ex. |
| 18 | C | CR | $4.2 \times 10^7$ | 0.58 | 72 | 2 | 25 | A(1) | x | 1079 | Comp. ex. |
| 19 | C | CR | $1.8 \times 10^8$ | 0 | 73 | 3 | 24 | — | Good | 842 | Comp. ex. |
| 20 | C | EG | $2.6 \times 10^9$ | 0.57 | 72 | 2 | 26 | — | Good | 996 | Inv. ex. |
| 21 | D | GI | $2.2 \times 10^9$ | 0.35 | 62 | 0 | 38 | — | Good | 1204 | Inv. ex. |
| 22 | D | GA | $2.6 \times 10^9$ | 0.36 | 64 | 0 | 36 | — | Good | 1192 | Inv. ex. |
| 23 | D | GA | $2.5 \times 10^6$ | 0.08 | 65 | 1 | 34 | — | x | 1245 | Comp. ex. |
| 24 | D | GA | $8.9 \times 10^7$ | 0.35 | 64 | 0 | 36 | — | x | 1206 | Comp. ex. |
| 25 | D | GA | $4.4 \times 10^6$ | 0.08 | 64 | 1 | 35 | — | x | 1259 | Comp. ex. |
| 26 | D | GA | $1.6 \times 10^8$ | 0 | 65 | 0 | 35 | — | Good | 884 | Comp. ex. |
| 27 | D | GA | $2.3 \times 10^7$ | 0 | 89 | 0 | 0 | C(11) | Good | 824 | Comp. ex. |
| 28 | D | GA | $4.6 \times 10^7$ | 0 | 76 | 0 | 0 | P(24) | Good | 862 | Comp. ex. |
| 29 | E | GA | $3.4 \times 10^9$ | 0.1 | 51 | 22 | 27 | — | Good | 1209 | Inv. ex. |

Underlines show outside scope of present invention

*1CR: cold rolled steel plate, EG: electrogalvanized steel plate, GI: hot dip galvanized steel plate, GA: hot dip galvannealed steel plate

*3Respective structures not present, so not measureable

TABLE 8

| Exp. ex. | Chemical Compositions | Steel type*1 | Number density of iron-based carbides particles/mm$^3$ | Content of Si or Si + Al mass % | Volume rate F | Volume rate B | Volume rate M | Balance structure | Hydrogen embrittlement resistance | TS MPa | Remarks |
|---|---|---|---|---|---|---|---|---|---|---|---|
| 30 | E | GA | $6.7 \times 10^7$ | 0.12 | 49 | 21 | 30 | — | x | 1221 | Comp. ex. |
| 31 | E | GA | $2.8 \times 10^6$ | 0.14 | 51 | 23 | 26 | — | x | 1276 | Comp. ex. |
| 32 | E | GA | $7.6 \times 10^6$ | 0 | 88 | 0 | 0 | C(12) | Good | 782 | Comp. ex. |
| 33 | E | GA | $4.9 \times 10^7$ | 0 | 73 | 0 | 0 | P(27) | Good | 849 | Comp. ex. |
| 34 | F | EG | $2.6 \times 10^9$ | 0.39 | 63 | 3 | 22 | A(2) | Good | 1189 | Inv. ex. |

TABLE 8-continued

| Exp. ex. | Chemical Compositions | Steel type*1 | Number density of iron-based carbides particles/mm$^3$ | Content of Si or Si + Al mass % | Volume rate F | B | M | Balance structure | Hydrogen embrittlement resistance | TS MPa | Remarks |
|---|---|---|---|---|---|---|---|---|---|---|---|
| 35 | G | GA | $8.8 \times 10^9$ | 0.16 | 62 | 3 | 35 | — | Good | 1213 | Inv. ex. |
| 36 | G | GA | $\underline{8.4 \times 10^7}$ | 0.13 | 61 | 2 | 37 | — | x | 1243 | Comp. ex. |
| 37 | G | GA | $\underline{6.8 \times 10^6}$ | 0.15 | 63 | 1 | 36 | — | x | 1281 | Comp. ex. |
| 38 | G | GA | $\underline{6.4 \times 10^7}$ | 0 | 74 | 0 | 0 | P(26) | Good | 872 | Comp. ex. |
| 39 | H | GA | $3.2 \times 10^9$ | 0.24 | 48 | 28 | 24 | — | Good | 1246 | Inv. ex. |
| 40 | I | GA | $3.8 \times 10^9$ | 0.16 | 51 | 25 | 24 | — | Good | 1248 | Inv. ex. |
| 41 | J | GA | $2.3 \times 10^9$ | 0.17 | 44 | 27 | 29 | — | Good | 1342 | Inv. ex. |
| 42 | K | GI | $4.7 \times 10^9$ | 0.14 | 46 | 28 | 26 | — | Good | 1376 | Inv. ex. |
| 43 | L | GA | $4.2 \times 10^9$ | 0.11 | 45 | 26 | 29 | — | Good | 1345 | Inv. ex. |
| 44 | M | GI | $3.6 \times 10^9$ | 0.24 | 46 | 28 | 26 | — | Good | 1355 | Inv. ex. |
| 45 | N | GA | $3.0 \times 10^9$ | 0.26 | 44 | 25 | 31 | — | Good | 1361 | Inv. ex. |
| 46 | O | GI | $2.6 \times 10^9$ | 0.15 | 46 | 26 | 28 | — | Good | 1324 | Inv. ex. |
| 47 | P | GA | $4.4 \times 10^9$ | 0.18 | 46 | 28 | 26 | — | Good | 1351 | Inv. ex. |
| 48 | Q | GA | $7.2 \times 10^9$ | 0.22 | 44 | 26 | 30 | — | Good | 1492 | Inv. ex. |
| 49 | R | GA | $\underline{3.8 \times 10^8}$ | 0.13 | 86 | 7 | 7 | — | Good | 776 | Comp. ex. |
| 50 | S | GA | $4.2 \times 10^9$ | 0.25 | 96 | 4 | 0 | — | Good | 1786 | Comp. ex. |
| 51 | T | GA | $2.1 \times 10^8$ | 0.02 | 62 | 2 | 36 | — | x | 1234 | Comp. ex. |
| 52 | U | GA | $\underline{8.2 \times 10^7}$ | 0.75 | 68 | 0 | 32 | — | x | 1256 | Comp. ex. |
| 53 | V | GA | $\underline{3.2 \times 10^7}$ | 0.13 | 79 | 0 | 0 | P(21) | Good | 721 | Comp. ex. |
| 54 | W | GA | $9.8 \times 10^8$ | 0.11 | 0 | 32 | 68 | — | x | 1384 | Comp. ex. |
| 55 | X | GA | $2.9 \times 10^8$ | 0.14 | 81 | 0 | 19 | — | Good | 862 | Comp. ex. |
| 56 | Y | GA | $7.8 \times 10^8$ | 0.27 | 0 | 35 | 65 | — | x | 1592 | Comp. ex. |

Underlines show outside scope of present invention

*1CR: cold rolled steel plate, EG: electrogalvanized steel plate, GI: hot dip galvanized steel plate, GA: hot dip galvannealed steel plate

*3Respective structures not present, so not measureable

After the heat treatment, part of the experimental examples which were run through the continuous annealing line were electrogalvanized to produce electrogalvanized steel plates (EG) by the following methods.

The steel plates which were run through the continuous annealing line were pretreated for plating for alkali degreasing, rinsed, pickled, and rinsed in that order. Next, solution circulation type electrogalvanization systems using plating baths comprised of zinc sulfate, sodium sulfate, and sulfuric acid were used to galvanize the pretreated steel plates by a current density of 100 A/dm$^2$.

When running steel plates through a continuous hot dip galvanization line, the plates were annealed by the maximum heating temperatures which are shown in Table 5 and Table 6 and the residence times which are shown in Table 5 and Table 6, were cooled by the average cooling rates which are shown in Table 5 and Table 6, then were dipped in galvanization baths of the temperatures which are shown in Table 5 and Table 6, were cooled by the average cooling rates which are shown in Table 5 and Table 6 down to the cooling temperatures which are shown in Table 5 and Table 6, then were deformed by rolls of the radii which are shown in Table 5 and Table 6 by bending-unbending, then were heat treated for the heat treatment temperatures and times which are shown in Table 5 and Table 6.

Part of the experimental examples which were run through the continuous hot dip galvanization line were galvanized, then alloyed at the temperatures which are shown in Table 5 and Table 6, next were cooled by the average cooling rates which are shown in Table 5 and Table 6 down to the cooling end temperatures which are shown in Table 5 and Table 6.

Note that, when running the plates through a continuous hot dip galvanization line, the average cooling rates were made the same before and after dipping in the galvanization baths.

The thus obtained steel plates of the Experimental Examples 1 to 56 ((CR), (EG), (GI), and (GA) which are shown in Table 3 to Table 8) were investigated for steel plate structures of the insides of the steel plates by the EBSP method using FE-SEM. The volume rates of the structures of the insides of the steel plates were found by finding the area percentages of the structures by image analysis. The results are shown in Table 7 and Table 8.

The steel plates of Experimental Example 1 to Experimental Example 56 ((CR), (EG), (GI), and (GA) which are shown in Table 3 to Table 8) were investigated using a 3D atom probe field ion microscope (AP-FIM) to find the content of Si or Si and Al which is contained in the iron-based carbides and the number of iron-based carbides per unit volume (number density). The results are shown in Table 7 and Table 8.

As shown in Table 7 and Table 8, in Experimental Examples 1, 8, 9, 15, 16, 20 to 22, 29, 34, 35, and 39 to 48 of invention examples of the present invention, there were $4\times10^8$ (particles/mm$^3$) or more iron-based carbides which contain "Si" or "Si and Al" in 0.1% or more.

In Experimental Examples 3, 7, 10, 14, 19, 23, 25 to 28, 32, 33, 38, and 51 of the comparative examples, the amounts of Ai or Si and Al which were contained in iron-based carbides were insufficient. Further, in Experimental Examples 2 to 7, 10 to 14, 17 to 19, 23 to 28, 30 to 33, 36 to 38, 49, 52, and 53 of the comparative examples, the numbers of iron-based carbides per unit volume were insufficient.

The steel plates of Experimental Examples 1 to 56 were investigated for hydrogen embrittlement resistance by the methods which are shown below.

The steel plates of Experimental Examples 1 to 56 were investigated for hydrogen embrittlement resistance by the methods which are shown below.

The obtained steel plates were sheared to fabricate test pieces of 1.2 mm×30 mm×100 mm so that the direction vertical to the rolling direction became the long direction and machined off the end faces.

The end faces were machined off to enable suitable evaluation of the effect of improvement of the delayed fracture resistance by the softened layer of the steel plate surface by prevention of delayed fracture occurring starting from defects which were introduced at the time of shearing.

After that, each test piece was bent by the pushing method to prepare a radius 5 R bending test piece. The amount of opening of the bending test piece after removal of the stress was made 40 mm.

A strain gauge was attached to the surface of each bending test piece, was fastened by bolts to cause elastic deformation of the bending test piece, and the amount of strain was read to calculate the load stress.

After that, each bending test piece was dipped in an ammonium thiocyanate aqueous solution and electrolytically charged by a current density of 1.0 mA/cm$^2$ to make hydrogen penetrate into the steel plate for a delayed fracture acceleration test.

Test pieces in which no cracking occurred even if the electrolytic charge time reached 100 hours were evaluated as steel plates which have "good" delayed fracture resistance, while those in which cracking occurred were evaluated as "poor".

The results are shown in Table 7 and Table 8. As shown in Table 7 and Table 8, in the invention examples of the present invention, the evaluation was "good" and the hydrogen embrittlement resistance was excellent.

In Experimental Examples 2, 4 to 6, 11 to 13, 17, 18, 23 to 25, 30, 31, 36, 37, 51, 52, 54, and 56 of the comparative examples, the evaluation was "poor" and the hydrogen embrittlement resistance was insufficient.

Tensile test pieces based on JIS Z 2201 were taken from the steel plates of Experimental Examples 1 to 56, tensile tests were performed based on JIS Z 2241, and the ultimate tensile strengths (TS) were measured.

The results are shown in Table 7 and Table 8. As shown in Table 7 and Table 8, in the invention examples of the present invention, the ultimate tensile strengths were 900 MPa or more.

In Experimental Examples 3, 7, 10, 14, 19, 26 to 28, 32, 33, 38, 49, 53, and 55 of the comparative examples, the ultimate tensile strengths were insufficient.

Example 2

Slabs which have the chemical compositions of Z to AL which are shown in Table 9 and Table 10 were cast, then immediately after casting were hot rolled under the conditions which are shown in Table 11 (slab heating temperature, hot rolling end temperature). Next, the hot rolled steel plates were coiled at the coiling temperatures which are shown in Table 11 and pickled.

After pickling, the plates were cold rolled to the drafts which are shown in Table 11 to obtain 1.6 mm thick cold rolled steel plates (cold rolled steel plates of Experimental Examples 57 to 93 shown in Table 11).

TABLE 9

| Exp. ex. | C mass % | Si mass % | Mn mass % | P mass % | S mass % | Al mass % | N mass % | O mass % |
|---|---|---|---|---|---|---|---|---|
| Z | 0.155 | 0.69 | 2.31 | 0.007 | 0.0029 | 0.051 | 0.0028 | 0.0036 |
| AA | 0.195 | 2.05 | 2.23 | 0.008 | 0.0049 | 0.030 | 0.0060 | 0.0033 |
| AB | 0.134 | 1.94 | 2.17 | 0.013 | 0.0052 | 0.041 | 0.0035 | 0.0035 |
| AC | 0.203 | 1.90 | 2.21 | 0.007 | 0.0051 | 0.022 | 0.0061 | 0.0011 |
| AD | 0.198 | 0.80 | 3.00 | 0.020 | 0.0010 | 0.187 | 0.0057 | 0.0034 |
| AE | 0.241 | 2.22 | 2.07 | 0.009 | 0.0048 | 0.031 | 0.0047 | 0.0025 |
| AF | 0.166 | 0.99 | 2.94 | 0.020 | 0.0013 | 0.370 | 0.0043 | 0.0037 |
| AG | 0.180 | 1.23 | 2.38 | 0.015 | 0.0052 | 0.013 | 0.0056 | 0.0030 |
| AH | 0.128 | 1.30 | 1.86 | 0.010 | 0.0011 | 0.519 | 0.0053 | 0.0010 |
| AI | 0.235 | 1.76 | 1.82 | 0.022 | 0.0018 | 0.033 | 0.0061 | 0.0037 |
| AJ | 0.220 | 0.79 | 2.99 | 0.018 | 0.0053 | 0.617 | 0.0054 | 0.0020 |
| AK | 0.179 | 1.18 | 2.19 | 0.015 | 0.0046 | 0.149 | 0.0015 | 0.0026 |
| AL | 0.119 | 1.66 | 2.55 | 0.010 | 0.0020 | 0.041 | 0.0050 | 0.0019 |

TABLE 10

| Exp. ex. | Ti mass % | Nb mass % | B mass % | Cr mass % | Ni mass % | Cu mass % | Mo mass % | V mass % | Ca mass % | Ce mass % | Mg mass % | REM mass % | |
|---|---|---|---|---|---|---|---|---|---|---|---|---|---|
| Z | | | | | | | | | | | | | Inv. ex. |
| AA | | | | | | | | | | | | | Inv. ex. |
| AB | | | | | | | | | | | | | Inv. ex. |
| AC | 0.029 | | | | | | | | | | | | Inv. ex. |
| AD | | 0.009 | | | | | | | | | | | Inv. ex. |
| AE | | | 0.0008 | | | | | | | | | | Inv. ex. |
| AF | | | | 0.19 | | | | | | | | | Inv. ex. |
| AG | | | | | 0.20 | 0.13 | | | | | | | Inv. ex. |
| AH | | | | | | | 0.11 | | | | | | Inv. ex. |
| AI | | | | | | | | | 0.0007 | | | | Inv. ex. |
| AJ | | | | | | | | | | 0.0018 | | | Inv. ex. |
| AK | | | | | | | | | | | | 0.0021 | Inv. ex. |
| AL | 0.025 | 0.011 | 0.0013 | 0.12 | 0.12 | 0.08 | 0.04 | | 0.0008 | 0.0021 | | | Inv. ex. |

TABLE 11

| Exp. ex. | Chemical Compositions | Steel type | Slab heating temp. ° C. | $Ar_3$ trans. point ° C. | Hot rolling end temp. ° C. | Coiling temp. ° C. | Draft % | |
|---|---|---|---|---|---|---|---|---|
| 57 | Z | CR | 1220 | 661 | 890 | 620 | 50 | Inv. ex. |
| 58 | Z | CR | 1190 | 661 | 880 | 640 | 50 | Inv. ex. |

TABLE 11-continued

| Exp. ex. | Chemical Compositions | Steel type | Slab heating temp. ° C. | $Ar_3$ trans. point ° C. | Hot rolling end temp. ° C. | Coiling temp. ° C. | Draft % | |
|---|---|---|---|---|---|---|---|---|
| 59 | Z | CR | 1210 | 661 | 890 | 650 | 50 | Comp. ex. |
| 60 | AA | CR | 1170 | 700 | 880 | 510 | 57 | Inv. ex. |
| 61 | AA | CR | 1260 | 700 | 870 | 470 | 57 | Inv. ex. |
| 62 | AA | GI | 1210 | 700 | 870 | 530 | 57 | Inv. ex. |
| 63 | AB | CR | 1220 | 722 | 900 | 650 | 50 | Inv. ex. |
| 64 | AB | CR | 1260 | 722 | 900 | 630 | 50 | Inv. ex. |
| 65 | AB | GA | 1230 | 722 | 890 | 610 | 50 | Inv. ex. |
| 66 | AC | CR | 1250 | 694 | 960 | 530 | 50 | Inv. ex. |
| 67 | AC | CR | 1180 | 694 | 960 | 560 | 50 | Inv. ex. |
| 68 | AC | EG | 1250 | 694 | 940 | 510 | 50 | Inv. ex. |
| 69 | AD | CR | 1240 | 587 | 930 | 550 | 63 | Inv. ex. |
| 70 | AD | GA | 1260 | 587 | 930 | 540 | 63 | Inv. ex. |
| 71 | AD | GI | 1190 | 587 | 910 | 570 | 63 | Inv. ex. |
| 72 | AE | CR | 1200 | 705 | 870 | 470 | 57 | Inv. ex. |
| 73 | AE | CR | 1250 | 705 | 870 | 490 | 57 | Inv. ex. |
| 74 | AE | EG | 1210 | 705 | 850 | 440 | 57 | Inv. ex. |
| 75 | AF | CR | 1260 | 601 | 890 | 560 | 47 | Inv. ex. |
| 76 | AF | EG | 1230 | 601 | 880 | 540 | 47 | Inv. ex. |
| 77 | AF | GA | 1250 | 601 | 880 | 590 | 47 | Inv. ex. |
| 78 | AG | CR | 1230 | 649 | 960 | 510 | 63 | Inv. ex. |
| 79 | AG | CR | 1190 | 649 | 960 | 520 | 57 | Inv. ex. |
| 80 | AG | CR | 1180 | 649 | 940 | 540 | 47 | Comp. ex. |
| 81 | AH | CR | 1170 | 726 | 940 | 650 | 53 | Inv. ex. |
| 82 | AH | GA | 1240 | 726 | 940 | 650 | 53 | Inv. ex. |
| 83 | AH | GA | 1170 | 726 | 940 | 660 | 53 | Inv. ex. |
| 84 | AI | CR | 1200 | 715 | 960 | 570 | 50 | Inv. ex. |
| 85 | AI | GI | 1250 | 715 | 950 | 550 | 50 | Inv. ex. |
| 86 | AI | CR | 1190 | 715 | 960 | 550 | 50 | Comp. ex. |
| 87 | AJ | CR | 1190 | 580 | 910 | 580 | 50 | Inv. ex. |
| 88 | AJ | GI | 1190 | 580 | 910 | 560 | 50 | Inv. ex. |
| 89 | AJ | CR | 1170 | 580 | 890 | 600 | 50 | Comp. ex. |
| 90 | AK | CR | 1190 | 680 | 880 | 660 | 63 | Inv. ex. |
| 91 | AK | GA | 1170 | 680 | 880 | 660 | 63 | Inv. ex. |
| 92 | AL | CR | 1180 | 666 | 920 | 530 | 63 | Inv. ex. |
| 93 | AL | GA | 1250 | 666 | 920 | 510 | 63 | Inv. ex. |

The cold rolled steel plates of Experimental Examples 57 to 93 were run through the continuous annealing line or continuous hot dip galvanization line to produce the steel plate (cold rolled steel plate (CR), electrogalvanized steel plate (EG), hot dip galvanized steel plate (GI), and hot dip galvannealed steel plate (GA) of Experimental Examples 57 to Experimental Examples 93 which are shown in Table 11 to Table 13).

When running the steel plates through a continuous annealing line, they were annealed at the maximum heating temperatures which are shown in Table 12, then cooled by the average cooling rates which are shown in Table 12 down to the cooling end temperatures which are shown in Table 12, then deformed by rolls of the radius which are shown in Table 12 by bending-unbending, then heat treated by the heat treatment temperatures and times which are shown in Table 12.

TABLE 12

| Exp. ex. | Chemical Composi-tions | Steel type | Residence time at annealing heating Sec | Max. heating temp. ° C. | Ave. cooling rate ° C./sec | Cooling end temp. ° C. | Martensite transformation start point ° C. | Roll radius mm | Heat treat. temp. ° C. | Heat treat. time Sec | Galv. bath temp. ° C. | Alloying temp. ° C. | Remarks |
|---|---|---|---|---|---|---|---|---|---|---|---|---|---|
| 57 | Z | CR | 90 | 830 | 5 | 310 | 380 | 600 | 320 | 500 | — | — | Inv. ex. |
| 58 | Z | CR | 90 | 810 | 6 | 320 | 373 | 600 | 350 | 500 | — | — | Inv. ex. |
| 59 | Z | CR | 90 | 820 | 10 | 110 | 346 | 600 | — | — | — | — | Comp. ex. |
| 60 | AA | CR | 90 | 810 | 5 | 240 | 326 | 600 | 380 | 500 | — | — | Inv. ex. |
| 61 | AA | CR | 90 | 830 | 8 | 300 | 348 | 600 | 380 | 500 | — | — | Inv. ex. |
| 62 | AA | GI | 60 | 830 | 5 | 290 | 346 | 450 | 370 | 16 | 460 | — | Inv. ex. |
| 63 | AB | CR | 90 | 850 | 8 | 300 | 367 | 600 | 320 | 500 | — | — | Inv. ex. |
| 64 | AB | CR | 90 | 860 | 4 | 330 | 378 | 600 | 380 | 500 | — | — | Inv. ex. |
| 65 | AB | GA | 60 | 870 | 8 | 290 | 367 | 450 | 330 | 16 | 450 | 510 | Inv. ex. |
| 66 | AC | CR | 120 | 850 | 3 | 310 | 366 | 600 | 310 | 700 | — | — | Inv. ex. |
| 67 | AC | CR | 120 | 870 | 5 | 310 | 347 | 600 | 330 | 700 | — | — | Inv. ex. |
| 68 | AC | EG | 120 | 850 | 4 | 300 | 359 | 600 | 390 | 700 | — | — | Inv. ex. |
| 69 | AD | CR | 120 | 860 | 5 | 280 | 329 | 600 | 280 | 700 | — | — | Inv. ex. |
| 70 | AD | GA | 80 | 860 | 8 | 260 | 317 | 450 | 290 | 16 | 440 | 510 | Inv. ex. |
| 71 | AD | GI | 80 | 870 | 5 | 220 | 302 | 450 | 320 | 16 | 450 | — | Inv. ex. |

TABLE 12-continued

| Exp. ex. | Chemical Composi-tions | Steel type | Residence time at annealing heating Sec | Max. heating temp. ° C. | Ave. cooling rate ° C./sec | Cooling end temp. ° C. | Martensite transformation start point ° C. | Roll radius mm | Heat treat. temp. ° C. | Heat treat. time Sec | Galv. bath temp. ° C. | Alloying temp. ° C. | Remarks |
|---|---|---|---|---|---|---|---|---|---|---|---|---|---|
| 72 | AE | CR | 120 | 830 | 3 | 250 | 338 | 600 | 380 | 700 | — | — | Inv. ex. |
| 73 | AE | CR | 120 | 830 | 3 | 290 | 334 | 600 | 390 | 700 | — | — | Inv. ex. |
| 74 | AE | EG | 120 | 850 | 6 | 260 | 317 | 600 | 300 | 700 | — | — | Inv. ex. |
| 75 | AF | CR | 120 | 870 | 4 | 240 | 322 | 600 | 300 | 700 | — | — | Inv. ex. |
| 76 | AF | EG | 120 | 850 | 6 | 250 | 340 | 600 | 300 | 700 | — | — | Inv. ex. |
| 77 | AF | GA | 80 | 840 | 7 | 250 | 317 | 450 | 370 | 16 | 450 | 500 | Inv. ex. |
| 78 | AG | CR | 90 | 870 | 7 | 310 | 348 | 600 | 330 | 500 | — | — | Inv. ex. |
| 79 | AG | CR | 90 | 840 | 7 | 240 | 323 | 600 | 310 | 500 | — | — | Inv. ex. |
| 80 | AG | CR | 90 | 830 | 5 | 340 | 318 | 600 | 390 | 500 | — | — | Comp. ex. |
| 81 | AH | CR | 90 | 870 | 4 | 320 | 404 | 600 | 350 | 500 | — | — | Inv. ex. |
| 82 | AH | GA | 60 | 870 | 7 | 310 | 386 | 450 | 340 | 12 | 460 | 510 | Inv. ex. |
| 83 | AH | GA | 60 | 860 | 8 | 320 | 410 | 450 | 350 | 12 | 450 | 500 | Inv. ex. |
| 84 | AI | CR | 90 | 840 | 3 | 290 | 355 | 600 | 350 | 500 | — | — | Inv. ex. |
| 85 | AI | GI | 60 | 870 | 3 | 290 | 327 | 450 | 370 | 12 | 460 | — | Inv. ex. |
| 86 | AI | CR | 90 | 850 | 5 | 240 | 340 | 600 | 700 | 140 | — | — | Comp. ex. |
| 87 | AJ | CR | 90 | 820 | 5 | 230 | 319 | 600 | 250 | 500 | — | — | Inv. ex. |
| 88 | AJ | GI | 60 | 830 | 3 | 270 | 336 | 450 | 300 | 12 | 450 | — | Inv. ex. |
| 89 | AJ | CR | 90 | 810 | 6 | 180 | 312 | 600 | 680 | 140 | — | — | Comp. ex. |
| 90 | AK | CR | 90 | 860 | 4 | 300 | 371 | 600 | 300 | 500 | — | — | Inv. ex. |
| 91 | AK | GA | 60 | 840 | 5 | 270 | 344 | 450 | 290 | 12 | 450 | 500 | Inv. ex. |
| 92 | AL | CR | 90 | 860 | 4 | 310 | 361 | 600 | 370 | 500 | — | — | Inv. ex. |
| 93 | AL | GA | 60 | 850 | 3 | 320 | 371 | 450 | 380 | 12 | 450 | 520 | Inv. ex. |

Part of the experimental examples which were run through the continuous annealing line were electrogalvanized to produce electrogalvanized steel plates (EG) in the same way as in Experimental Example 20.

When running steel plates through a continuous hot dip galvanization line, the plates were annealed by the maximum heating temperatures which are shown in Table 12 and the residence times which are shown in Table 12, then were cooled by the average cooling rates which are shown in Table 12, then were dipped in galvanization baths of the temperatures which are shown in Table 12, were cooled by the average cooling rates which are shown in Table 12 down to the cooling end temperatures which are shown in Table 12, next were deformed by rolls of the radii which are shown in Table 12 by bending-unbending, then were heat treated by the heat treatment temperatures and times which are shown in Table 12.

Part of the experimental examples which were run through the continuous hot dip galvanization line were dipped in a galvanization bath, then were alloyed at the temperatures which are shown in Table 12, then were cooled by the average cooling rates which are shown in Table 12 down to the cooling end temperatures which are shown in Table 12.

Note that, when running steel plates through a continuous hot dip galvanization line, the average cooling rates were made the same before and after being dipped in a galvanization bath.

The steel plates of Experimental Examples 57 to 93 ((CR), (EG), (GI), and (GA) indicated in Table 11 to Table 13) were investigated in the same way as Experimental Example 1 for the amounts of Si or Si and Al which were contained in the iron-based carbides and the number of iron-based carbides per unit volume (number density). The results are shown in Table 13.

TABLE 13

| Exp. ex. | Chemical Composi-tions | Steel type | Number density of iron-based carbides particles/mm$^3$ | Content of Si or Si + Al % | Volume rate (%) F | B | BF | TM | M | A | Dislocation density ($10^{13}$/m$^2$) B | BF | TM | M | Hydrogen embrittlement resistance | TS MPa | |
|---|---|---|---|---|---|---|---|---|---|---|---|---|---|---|---|---|---|
| 57 | Z | CR | $1.9 \times 10^9$ | 0.45 | 28 | 45 | 0 | 23 | 4 | 0 | 43 | 25 | 84 | 312 | Good | 1054 | Inv. ex. |
| 58 | Z | CR | $2.6 \times 10^9$ | 0.62 | 33 | 28 | 15 | 15 | 0 | 9 | 22 | 58 | 102 | — | Good | 1070 | Inv. ex. |
| 59 | Z | CR | $2.1 \times 10^7$ | 0.00 | 46 | 0 | 0 | 0 | 51 | 3 | — | — | — | 285 | Poor | 1105 | Comp. ex. |
| 60 | AA | CR | $2.0 \times 10^9$ | 0.32 | 39 | 0 | 24 | 29 | 0 | 8 | — | 55 | 272 | — | Good | 1265 | Inv. ex. |
| 61 | AA | CR | $4.2 \times 10^9$ | 0.43 | 29 | 5 | 33 | 20 | 0 | 13 | 13 | 37 | 140 | — | Good | 1193 | Inv. ex. |
| 62 | AA | GI | $5.5 \times 10^9$ | 0.19 | 30 | 11 | 32 | 17 | 0 | 10 | 24 | 43 | 180 | — | Good | 1248 | Inv. ex. |
| 63 | AB | CR | $7.0 \times 10^8$ | 0.24 | 44 | 23 | 8 | 16 | 0 | 9 | 46 | 30 | 300 | — | Good | 994 | Inv. ex. |
| 64 | AB | CR | $4.9 \times 10^9$ | 0.15 | 38 | 0 | 33 | 15 | 6 | 8 | — | 102 | 98 | 423 | Good | 1053 | Inv. ex. |
| 65 | AB | GA | $4.9 \times 10^9$ | 0.20 | 44 | 8 | 19 | 22 | 0 | 7 | 58 | 19 | 263 | — | Good | 937 | Inv. ex. |
| 66 | AC | CR | $3.9 \times 10^9$ | 0.35 | 15 | 5 | 40 | 26 | 0 | 14 | 20 | 75 | 137 | — | Good | 1239 | Inv. ex. |
| 67 | AC | CR | $9.3 \times 10^8$ | 0.19 | 27 | 9 | 31 | 13 | 4 | 16 | 39 | 51 | 76 | 334 | Good | 1175 | Inv. ex. |
| 68 | AC | EG | $1.2 \times 10^9$ | 0.20 | 20 | 0 | 37 | 23 | 6 | 14 | — | 48 | 225 | 657 | Good | 1301 | Inv. ex. |
| 69 | AD | CR | $1.5 \times 10^9$ | 0.57 | 29 | 30 | 13 | 18 | 0 | 10 | 46 | 81 | 198 | — | Good | 1222 | Inv. ex. |
| 70 | AD | GA | $4.4 \times 10^9$ | 0.54 | 35 | 32 | 0 | 31 | 2 | 0 | 31 | — | 85 | 145 | Good | 1168 | Inv. ex. |
| 71 | AD | GI | $2.8 \times 10^9$ | 0.34 | 41 | 17 | 15 | 22 | 0 | 5 | 33 | 34 | 150 | — | Good | 1250 | Inv. ex. |
| 72 | AE | CR | $5.1 \times 10^9$ | 0.17 | 21 | 0 | 31 | 35 | 0 | 13 | — | 63 | 77 | — | Good | 1331 | Inv. ex. |
| 73 | AE | CR | $1.3 \times 10^9$ | 0.39 | 23 | 0 | 48 | 14 | 4 | 11 | — | 120 | 89 | 506 | Good | 1286 | Inv. ex. |

TABLE 13-continued

| Exp. ex. | Chemical Composi-tions | Steel type | Number density of iron-based carbides particles/mm³ | Content of Si or Si + Al % | Volume rate (%) F | B | BF | TM | M | A | Dislocation density ($10^{13}/m^2$) B | BF | TM | M | Hydrogen embrittlement resistance | TS MPa | |
|---|---|---|---|---|---|---|---|---|---|---|---|---|---|---|---|---|---|
| 74 | AE | EG | $2.2 \times 10^9$ | 0.29 | 31 | 15 | 28 | 19 | 0 | 7 | 42 | 156 | 230 | — | Good | 1236 | Inv. ex. |
| 75 | AF | CR | $5.5 \times 10^9$ | 0.48 | 44 | 13 | 15 | 25 | 3 | 0 | 28 | 58 | 188 | | Good | 1192 | Inv. ex. |
| 76 | AF | EG | $3.2 \times 10^9$ | 0.53 | 36 | 24 | 5 | 29 | 3 | 3 | 36 | 28 | 410 | 250 | Good | 1167 | Inv. ex. |
| 77 | AF | GA | $1.5 \times 10^9$ | 0.16 | 46 | 5 | 15 | 21 | 7 | 6 | 39 | 19 | 292 | 481 | Good | 1170 | Inv. ex. |
| 78 | AG | CR | $5.6 \times 10^8$ | 0.12 | 32 | 0 | 47 | 12 | 0 | 9 | — | 134 | 117 | — | Good | 1134 | Inv. ex. |
| 79 | AG | CR | $2.0 \times 10^9$ | 0.22 | 43 | 10 | 16 | 21 | 3 | 7 | 20 | 80 | 370 | 457 | Good | 1098 | Inv. ex. |
| 80 | AG | CR | $\underline{1.8 \times 10^8}$ | 0.00 | 45 | 0 | 41 | 0 | 2 | 12 | — | 135 | — | 106 | Poor | 1045 | Comp. ex. |
| 81 | AH | CR | $1.1 \times 10^9$ | 0.15 | 39 | 8 | 16 | 24 | 0 | 13 | 107 | 48 | 208 | — | Good | 1029 | Inv. ex. |
| 82 | AH | GA | $3.4 \times 10^9$ | 0.32 | 48 | 21 | 0 | 18 | 7 | 6 | 23 | — | 139 | 287 | Good | 977 | Inv. ex. |
| 83 | AH | GA | $4.6 \times 10^9$ | 0.49 | 35 | 24 | 3 | 27 | 3 | 8 | 49 | 68 | 243 | 494 | Good | 1008 | Inv. ex. |
| 84 | AI | CR | $1.7 \times 10^9$ | 0.26 | 19 | 19 | 33 | 22 | 0 | 7 | 56 | 198 | 55 | — | Good | 1303 | Inv. ex. |
| 85 | AI | GI | $9.9 \times 10^8$ | 0.30 | 33 | 4 | 32 | 16 | 0 | 15 | 36 | 70 | 162 | — | Good | 1219 | Inv. ex. |
| 86 | AI | CR | $\underline{3.2 \times 10^8}$ | 0.04 | 27 | 36 | 0 | 37 | 0 | 0 | 4 | — | 3 | — | Poor | 813 | Comp. ex. |
| 87 | AJ | CR | $5.1 \times 10^9$ | 0.17 | 31 | 39 | 0 | 27 | 3 | 0 | 34 | — | 94 | 370 | Good | 1029 | Inv. ex. |
| 88 | AJ | GI | $4.9 \times 10^9$ | 0.36 | 22 | 40 | 7 | 23 | 5 | 3 | 56 | 13 | 240 | 213 | Good | 1070 | Inv. ex. |
| 89 | AJ | CR | $\underline{1.1 \times 10^8}$ | 0.06 | 34 | 18 | 0 | 48 | 0 | 0 | 2 | — | 5 | — | Poor | 845 | Comp. ex. |
| 90 | AK | CR | $5.3 \times 10^9$ | 0.16 | 26 | 23 | 14 | 27 | 0 | 10 | 15 | 77 | 196 | — | Good | 1163 | Inv. ex. |
| 91 | AK | GA | $4.5 \times 10^9$ | 0.21 | 40 | 11 | 19 | 23 | 0 | 7 | 25 | 38 | 271 | — | Good | 1148 | Inv. ex. |
| 92 | AL | CR | $3.7 \times 10^9$ | 0.12 | 46 | 0 | 35 | 13 | 0 | 6 | — | 290 | 142 | — | Good | 1112 | Inv. ex. |
| 93 | AL | GA | $7.4 \times 10^8$ | 0.16 | 40 | 0 | 41 | 13 | 0 | 6 | — | 244 | 510 | — | Good | 1134 | Inv. ex. |

As shown in Table 13, in Experimental Examples 57, 58, 60 to 79, 81 to 85, 87, 88, and 90 to 93 of the invention examples of the present invention, there were $4 \times 10^8$ (particles/mm³) or more iron-based carbides which contained Si or Si and Al in 0.1% or more.

As opposed to this, in Experimental Examples 59, 80, 86, and 89 of the comparative examples, the amounts of the Si or Si and Al which are contained in the iron-based carbides were insufficient and the numbers of iron-based carbides per unit volume were insufficient.

Note that, Experimental Example 59 is an example where heat treatment could not be performed after the end of cooling. Experimental Example 80 is an experimental example where the cooling end temperature is outside the range of the present invention. Experimental Examples 86 and 89 are experimental examples where the heat treatment temperature is outside the range of the present invention.

The steel plates of the Experimental Examples 57 to 93 were investigated for hydrogen embrittlement resistance in the same way as Experimental Example 1 and evaluated in the same way as in Experimental Example 1. The results are shown in Table 13.

As shown in Table 13, in the invention examples of the present invention, the evaluation was "good" and the hydrogen embrittlement resistance was excellent. As opposed to this, in the comparative examples, the evaluation was "poor" and the hydrogen embrittlement resistance was insufficient.

The steel plates of the Experimental Examples 57 to 93 ((CR), (EG), (GI), and (GA) shown in Table 11 to Table 13) were observed for structure inside of the steel plate and measured for volume fraction of the structure by the following method.

The volume fraction of the retained austenite was found by X-ray analysis using the surface parallel to and at ¼ thickness from the surface of the steel plate as the observed surface, calculation of the area percentage of retained austenite, and conversion of this to the volume fraction.

The volume fractions of ferrite, bainitic ferrite, bainite, tempered martensite, and fresh martensite were found by obtaining samples using as the observed surfaces the cross-sections in thickness parallel to the rolling direction of the steel plate, polishing the observed surfaces, etching them by Nital, observing the ranges of ⅛ thickness to ⅜ thickness centered at ¼ of the thickness by a field emission type scan electron microscope (FE-SEM) to measure the area percentages, and converting these to the volume fractions.

Note that, the surfaces which were observed by FE-SEM were made squares of 30 μm sides. The structures at the observed surfaces could be differentiated as explained below.

Ferrite is comprised of clumps of crystal grains inside of which there are no iron-based carbides with long axes of 100 nm or more. Bainitic ferrite is a collection of lath-shaped crystal grains inside of which no iron-based carbides with long axes of 20 nm or more are not contained.

Bainite is a collection of lath-shaped crystal grains inside of which there are several iron-based carbides with long axes of 20 nm or more. Furthermore, these carbides fall into several variants, that is, several groups of iron-based carbides stretched in the same directions.

Tempered martensite is a collection of lath-shaped crystal grains inside of which there are several iron-based carbides with long axes of 20 nm or more. Furthermore, these carbides fall into several variants, that is, several groups of iron-based carbides stretched in different directions.

The volume fraction of fresh martensite was found as the difference between the area percentage of the regions which were not corroded observed by FE-SEM and the area percentage of the retained austenite which was measured by X-ray.

The results when finding the deposition fraction of the structure are shown in Table 13. Note that, in Table 13, F indicates ferrite, B indicates bainite, BF indicates bainitic ferrite, TM indicates tempered martensite, M indicates fresh martensite, and A indicates retained austenite.

As shown in Table 13, in the Experimental Examples 57, 58, 60 to 79, 81 to 85, 87, 88, and 90 to 93 of the invention examples of the present invention, the steel plate structure had, by volume fraction, ferrite: 10 to 50%, bainitic ferrite and or bainite: 10 to 60%, tempered martensite: 10 to 50%, and fresh martensite: 10% or less. When there is retained austenite present, it was present in 2 to 25%.

The steel plates of Experimental Examples 57 to 93 were observed using a transmission type electron microscope to investigate the dislocation density. Experimental Examples 57 to 93 were measured for ultimate tensile strength (TS) in the same way as Experimental Example 1. The results are shown in Table 13.

As shown in Table 13, in the invention examples of the present invention, the dislocation density of tempered martensite became $10^{14}/m^2$ or more and the ultimate tensile strength was 900 MPa or more.

As opposed to this, in Experimental Examples 86 and 89 of the comparative examples, the heat treatment temperature was high, so the dislocation density of the tempered martensite was less than $10^{14}/m^2$ and the ultimate tensile strength was insufficient.

INDUSTRIAL APPLICABILITY

As explained above, according to the present invention, it is possible to achieve both delayed fracture resistance and excellent shapeability and provide high strength steel plate with an ultimate tensile strength of 900 MPa or more which is excellent in hydrogen embrittlement resistance. Due to this, the present invention is high in applicability in industries producing steel plate and industries utilizing steel plate.

The invention claimed is:

1. A high strength steel plate with an ultimate tensile strength of 900 MPa or more, wherein in the structure of the steel plate, (a) by volume fraction, ferrite is present in 10 to 50%, at least one of bainitic ferrite or bainite is present in 10 to 60%, and tempered martensite is present in 10 to 50%, and (b) iron-based carbides which contain Si or Si and A1 in 0.1 mass % or more are present in $4\times10^8$ particles/$mm^3$ or more.

2. The high strength steel plate with an ultimate tensile strength of 900 MPa or more as set forth in claim 1, wherein in said structure of the steel plate, by volume fraction, fresh martensite is present in 10% or less.

3. The high strength steel plate with an ultimate tensile strength of 900 MPa or more as set forth in claim 1 or 2, wherein in said structure of the steel plate, by volume fraction, retained austenite is present in 2 to 25%.

4. The high strength steel plate with an ultimate tensile strength of 900 MPa or more as set forth in claim 1 or 2, wherein said iron-based carbides are present in at least one of the bainite or the tempered martensite.

5. The high strength steel plate with an ultimate tensile strength of 900 MPa or more as set forth in claim 1 or 2, wherein said steel plate contains, by mass %, C: 0.07% to 0.25%, Si: 0.45 to 2.50%, Mn: 1.5 to 3.20%, P: 0.001 to 0.03%, S: 0.0001 to 0.01%, Al: 0.005 to 2.5%, N: 0.0001 to 0.0100%, and O: 0.0001 to 0.0080% and has a balance of iron and unavoidable impurities.

6. The high strength steel plate with an ultimate tensile strength of 900 MPa or more as set forth in claim 5, wherein said steel plate further contains, by mass %, one or more of Ti: 0.005 to 0.09%, Nb: 0.005 to 0.09%, B: 0.0001 to 0.01%, Cr: 0.01 to 2.0%, Ni: 0.01 to 2.0%, Cu: 0.01 to 0.05%, Mo: 0.01 to 0.8%, V: 0.005 to 0.09%, and a group of one or more of Ca, Ce, Mg, and REM in a total of 0.0001 to 0.5%.

7. The high strength steel plate with an ultimate tensile strength of 900 MPa or more as set forth in claim 1 or 2, wherein said steel plate has a galvanized layer on its surface.

8. A method of production for producing a high strength steel plate with an ultimate tensile strength of 900 MPa or more, said method comprising:

(a) casting a slab which contains, by mass %, C: 0.07% to 0.25%, Si: 0.45 to 2.50%, Mn: 1.5 to 3.20%, P: 0.001 to 0.03%, S: 0.0001 to 0.01%, Al: 0.005 to 2.5%, N: 0.0001 to 0.0100%, and O: 0.0001 to 0.0080% and has a balance of iron and unavoidable impurities, directly, or after once cooling, heating to a 1050° C. or more temperature and hot rolling, finishing the hot rolling at a temperature of the Ara transformation point or more, coiling at a 400 to 670° C. temperature region, pickling, then cold rolling by a draft of 40 to 70%, next, (b) using a continuous annealing line for annealing at a maximum heating temperature of 760 to 900° C., then cooling by an average cooling rate of 1 to 1000° C./sec down to the Ms point to the Ms point −100° C., next (c) bending and unbending the steel plate by rolls of a radius of 800 mm or less, then performing heat treatment in the 150 to 400° C. temperature region for 5 seconds or more.

9. The method of production for producing a high strength steel plate with an ultimate tensile strength of 900 MPa or more as set forth in claim 8, said method further comprising galvanizing the steel plate surface after the heat treatment of (c).

10. The method of production for producing a high strength steel plate with an ultimate tensile strength of 900 MPa or more as set forth in claim 9, wherein said galvanization is electrogalvanization.

11. A method of production for producing a high strength steel plate with an ultimate tensile strength of 900 MPa or more, said method comprising:

(a) casting a slab which contains, by mass %, C: 0.07% to 0.25%, Si: 0.45 to 2.50%, Mn: 1.5 to 3.20%, P: 0.001 to 0.03%, S: 0.0001 to 0.01%, Al: 0.005 to 2.5%, N: 0.0001 to 0.0100%, and O: 0.0001 to 0.0080% and has a balance of iron and unavoidable impurities, directly, or after once cooling, heating to a 1050° C. or more temperature and hot rolling, finishing the hot rolling at a temperature of the Ara transformation point or more, coiling at a 400 to 670° C. temperature region, pickling, then cold rolling by a draft of 40 to 70%, next, (b) using a continuous hot dip galvanization line for annealing at a maximum heating temperature of 760 to 900° C., then cooling by an average cooling rate of 1 to 1000° C./sec, then dipping in a galvanization bath and cooling by an average cooling rate of 1° C./second or more down to the Ms point to the Ms point −100° C., next, (c) bending and unbending the steel plate by rolls of a radius of 800 mm or less, then performing heat treatment in the 150 to 400° C. temperature region for 5 seconds or more.

12. The method of production for producing a high strength steel plate with an ultimate tensile strength of 900 MPa or more as set forth in claim 11 further comprising performing alloying treatment at a 460 to 600° C. temperature after dipping in said galvanization bath, then cooling by an average cooling rate of 1° C./second or more down to the Ms point to the Ms point −100° C.

13. The method of production for producing a high strength steel plate with an ultimate tensile strength of 900 MPa or more as set forth in claim 8, wherein said slab further contains, by mass %, one or more of Ti: 0.005 to 0.09%, Nb: 0.005 to 0.09%, B: 0.0001 to 0.01%, Cr: 0.01 to 2.0%, Ni: 0.01 to 2.0%, Cu: 0.01 to 0.05%, Mo: 0.01 to 0.8%, V: 0.005 to 0.09%, and a group of one or more of Ca, Ce, Mg, and REM in a total of 0.0001 to 0.5%.

14. The method of production for producing a high strength steel plate with an ultimate tensile strength of 900 MPa or more as set forth in claim 11, wherein said slab further contains, by mass %, one or more of Ti: 0.005 to 0.09%, Nb: 0.005 to 0.09%, B: 0.0001 to 0.01%, Cr: 0.01 to 2.0%, Ni: 0.01 to 2.0%, Cu: 0.01 to 0.05%, Mo: 0.01 to 0.8%, V: 0.005 to 0.09%, and a group of one or more of Ca, Ce, Mg, and REM in a total of 0.0001 to 0.5%.

* * * * *